US008845141B2

(12) United States Patent
Wronski et al.

(10) Patent No.: US 8,845,141 B2
(45) Date of Patent: Sep. 30, 2014

(54) REFLECTORS AND REFLECTOR ATTACHMENTS FOR USE WITH LIGHT-EMITTING DIODE (LED) LIGHT SOURCES

(75) Inventors: Grzegorz Wronski, Peachtree City, GA (US); Steven Pyshos, Peachtree City, GA (US); Oliver Ernst, Peachtree City, GA (US); Christopher Ladewig, Fayetteville, GA (US); Gregg Arthur Lehman, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 253 days.

(21) Appl. No.: 13/466,835

(22) Filed: May 8, 2012

(65) Prior Publication Data

US 2012/0287644 A1 Nov. 15, 2012

Related U.S. Application Data

(60) Provisional application No. 61/485,978, filed on May 13, 2011.

(51) Int. Cl.

| | |
|---|---|
| ***F21V 7/22*** | (2006.01) |
| ***F21V 17/10*** | (2006.01) |
| ***F21V 13/00*** | (2006.01) |
| ***F21V 17/14*** | (2006.01) |
| *F21V 17/16* | (2006.01) |
| *F21V 9/00* | (2006.01) |
| *F21V 29/00* | (2006.01) |

(52) U.S. Cl.

CPC ..... *F21V 7/22* (2013.01); *F21V 17/164* (2013.01); *F21V 17/10* (2013.01); *F21V 13/00* (2013.01); *F21V 2101/02* (2013.01); *F21V 17/14* (2013.01); *F21V 9/00* (2013.01); *F21V 29/2231* (2013.01)

USPC ..... 362/296.01; 362/249.02; 362/350

(58) Field of Classification Search

CPC ..... F21V 7/22

USPC ..... 362/296.01, 235, 249.02, 341, 350

See application file for complete search history.

(56) References Cited

U.S. PATENT DOCUMENTS

| | | | | |
|---|---|---|---|---|
| 4,969,072 | A * | 11/1990 | Pye | 362/549 |
| 6,371,630 | B1 | 4/2002 | Unger | |
| 7,588,347 | B1 | 9/2009 | Edwards | |
| 2002/0141193 | A1 * | 10/2002 | Chong | 362/308 |

(Continued)

OTHER PUBLICATIONS

International Search Report for PCT/US2012/036945; mailed Oct. 12, 2012.

*Primary Examiner* — David V Bruce

(74) *Attorney, Agent, or Firm* — King & Spalding LLP

(57) ABSTRACT

A reflector is rotatably coupled to a light emitting diode (LED) module assembly. The reflector includes multiple alignment features that correspond with multiple notches provided in a reflector attachment coupled to a LED light source. The reflector can be made of a non-conductive substrate material, such as glass, and can have a non-conductive, reflective coating deposited on the inner surface of the reflector to allow the reflector to be more closely positioned to the LED light source. Reflector attachments can help to maintain precise reflector position during coupling with the LED light source. Media holders can be removably coupled to the light emitting portion of the reflector and provide for the quick mounting and placement of one or more optical media in the light path output by the reflector.

20 Claims, 34 Drawing Sheets

(56) References Cited

U.S. PATENT DOCUMENTS

2005/0265024 A1 12/2005 Luk
2007/0268706 A1 11/2007 Wagener et al.
2011/0019409 A1* 1/2011 Wronski ..... 362/235

* cited by examiner

REFLECTORS AND REFLECTOR ATTACHMENTS FOR USE WITH LIGHT-EMITTING DIODE (LED) LIGHT SOURCES

RELATED PATENT APPLICATION

This application claims priority under 35 U.S.C. §119 to U.S. Provisional Patent Application Ser. No. 61/485,978, filed May 13, 2011, and titled "Reflectors and Reflector Attachments for Use with Light-Emitting Diode (LED) Light Sources," the entire contents of which are hereby incorporated herein by reference.

TECHNICAL FIELD

The present disclosure relates generally to reflectors and reflector attachments for use with light-emitting diode (LED) light sources. More particularly, the present disclosure relates to reflectors having nonconductive reflective coatings on a nonconductive reflector substrate, and to reflector attachments or adapters configured to maintain precise reflector position and to provide placement of optical media when coupled to an LED module assembly.

BACKGROUND

Reflectors for use with LED light sources typically are constructed from conductive, reflective materials, such as aluminum or vacuum metalized substrates. A number of disadvantages exist when using reflectors of this type. For instance, the use of conductive materials in the entire reflector generally requires that an isolation gap be maintained between the reflector and LED light source. The isolation gap required is based on a minimum creepage distance to protect against electric discharges on or close to an insulation surface and a minimum clearance distance to prevent dielectric breakdown between conductive parts by the ionization of air. This requirement for the isolation gap results in a reflector that is too far from the LED light source. The resultant gap reduces the ability to control light being emitted from the light source as efficiently and effectively, as some light is typically lost along the gap. In addition, in instances where the reflector needs to be easily and quickly replaced, the coaxial orientation and position of the reflector must be maintained after the reflector is replaced so that the beam control and light distribution is not affected.

In the case of metalized reflectors, these reflectors can include a plastic piece that is injection molded, and then metalized with a conductive material to achieve a reflective surface. A coating, such as a lacquer coating, must be applied to the metalized surface thereafter to protect the metallization. However, the coating generally degrades over time and the reflectivity diminishes as a result. In general, as the coating degrades, the color accuracy and total system efficiency is impacted. In addition, these metalized reflectors are conductive.

SUMMARY

According to one exemplary aspect, a luminaire can include an LED module assembly and a reflector. The LED module assembly can include a LED light source and a reflector attachment disposed about the LED light source. The reflector can be rotatably coupled to the reflector attachment and can include a non-conductive substrate having an interior surface and an exterior surface. A non-conductive reflective coating can be disposed on the interior surface of the reflector.

According to another exemplary aspect, a reflector system can include a reflector having an exterior surface and an alignment feature protruding out from the exterior surface. The alignment feature can include a channel. The system can also include a reflector attachment that has an opening for receiving a first end of the reflector, a groove that corresponds to the size and shape of the alignment feature, and a ledge adjacent to the grooves. The ledge can be sized to engage the channel of the alignment feature when the reflector is coupled to the reflector attachment.

According to still another exemplary aspect, a reflector for a LED light source can include a first light receiving aperture positioned along a first end of the reflector, a distal light emitting aperture positioned along a second end of the reflector, and an interior surface disposed between the first and second ends. The interior surface an define a light pathway through the reflector. The reflector can also include a flange member extending our from an exterior surface of the reflector adjacent to the second end. The reflector can also include a media holder removably coupled to the second end of the reflector, with at least a portion of the media holder positioned over the flange member. The media holder can include an annular-shaped body that includes a first protrusion, a second protrusion and a first channel. The first protrusion can be located adjacent to a top surface of the body portion and extends from the inner surface of the body portion. The second protrusion can be located adjacent to a bottom surface of the body portion and extends from the inner surface of the body portion. A media can be removably coupled to the media holder. The media can have an outer perimeter surface that is positioned within the first channel.

These and other aspects, features, and embodiments will become apparent to a person of ordinary skill in the art upon consideration of the following detailed description of illustrated exemplary embodiments exemplifying the best mode for carrying out the invention as presently perceived.

BRIEF DESCRIPTION OF THE DRAWINGS

For a more complete understanding of the exemplary embodiments of the present invention and the advantages thereof, reference is now made to the following description in conjunction with the accompanying drawings, which are described below.

Figure 1A:
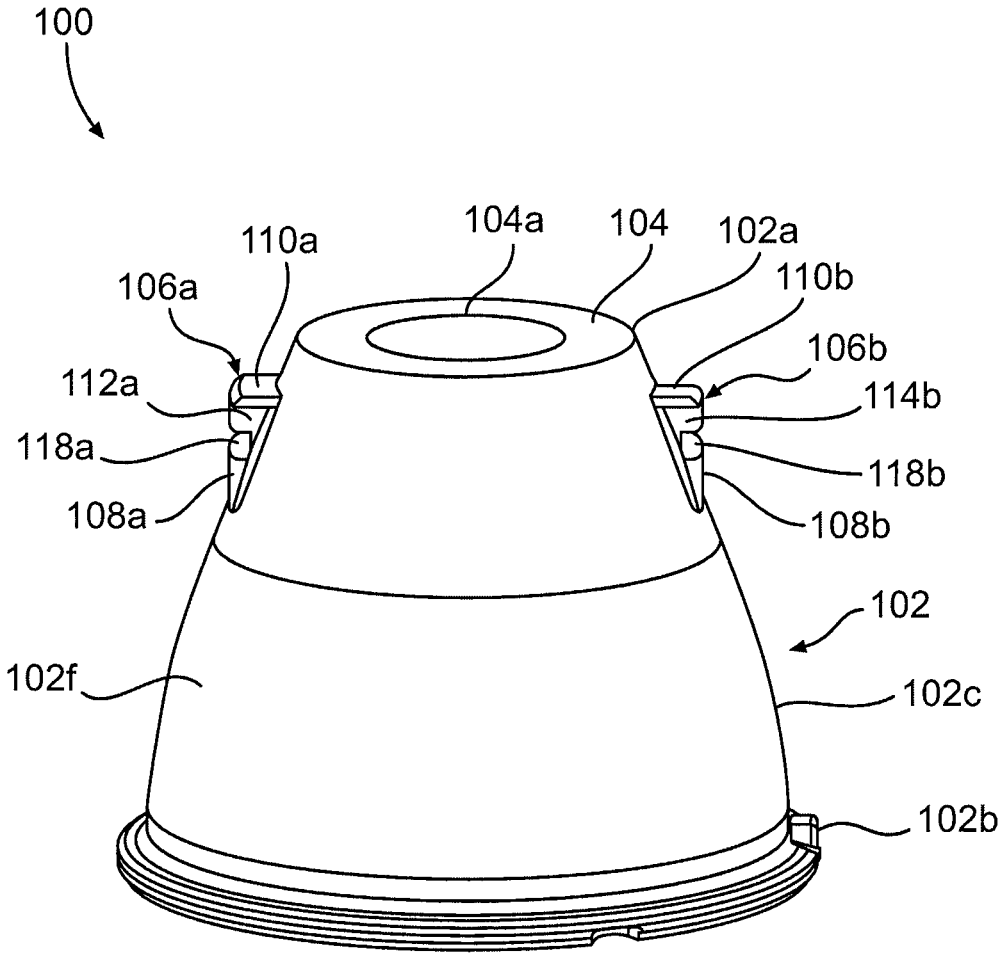
FIG. 1A is a perspective view of a reflector according to an exemplary embodiment.
Figure 1B:
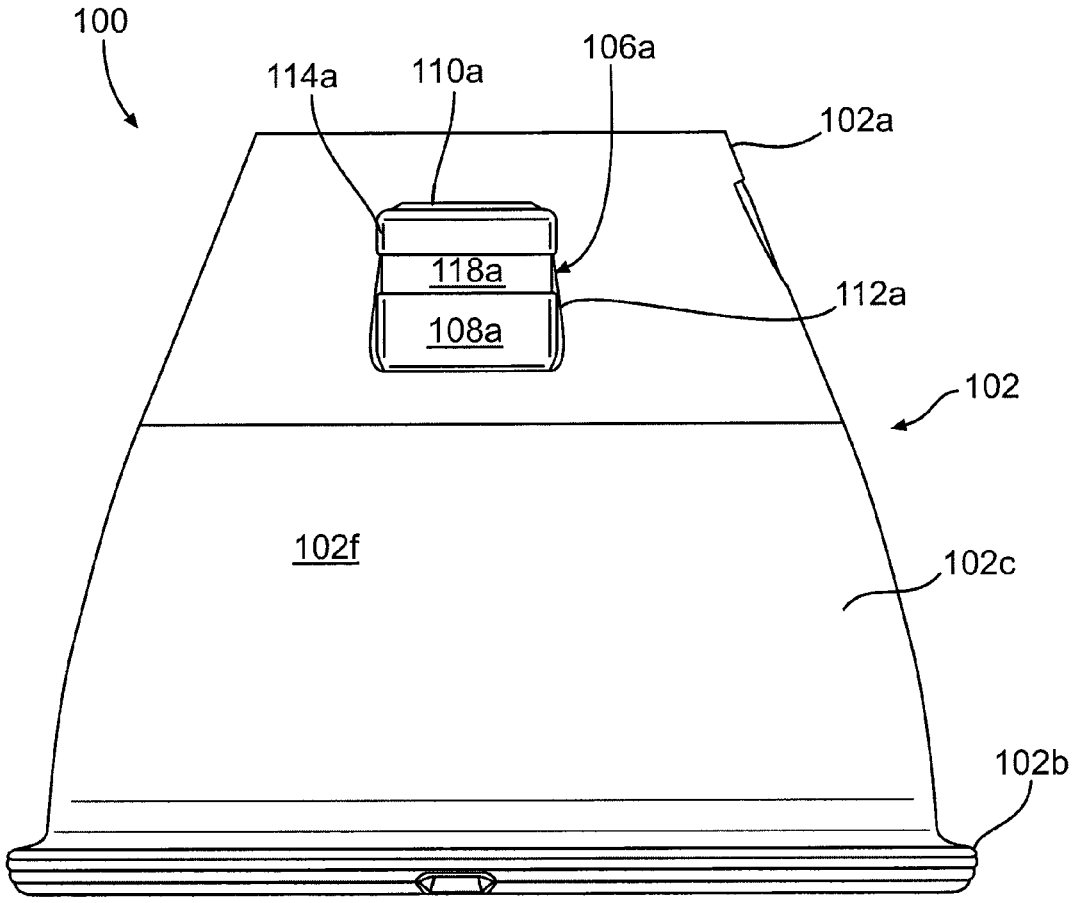
FIG. 1B is a side view of the reflector of FIG. 1A according to one exemplary embodiment.
Figure 1C:
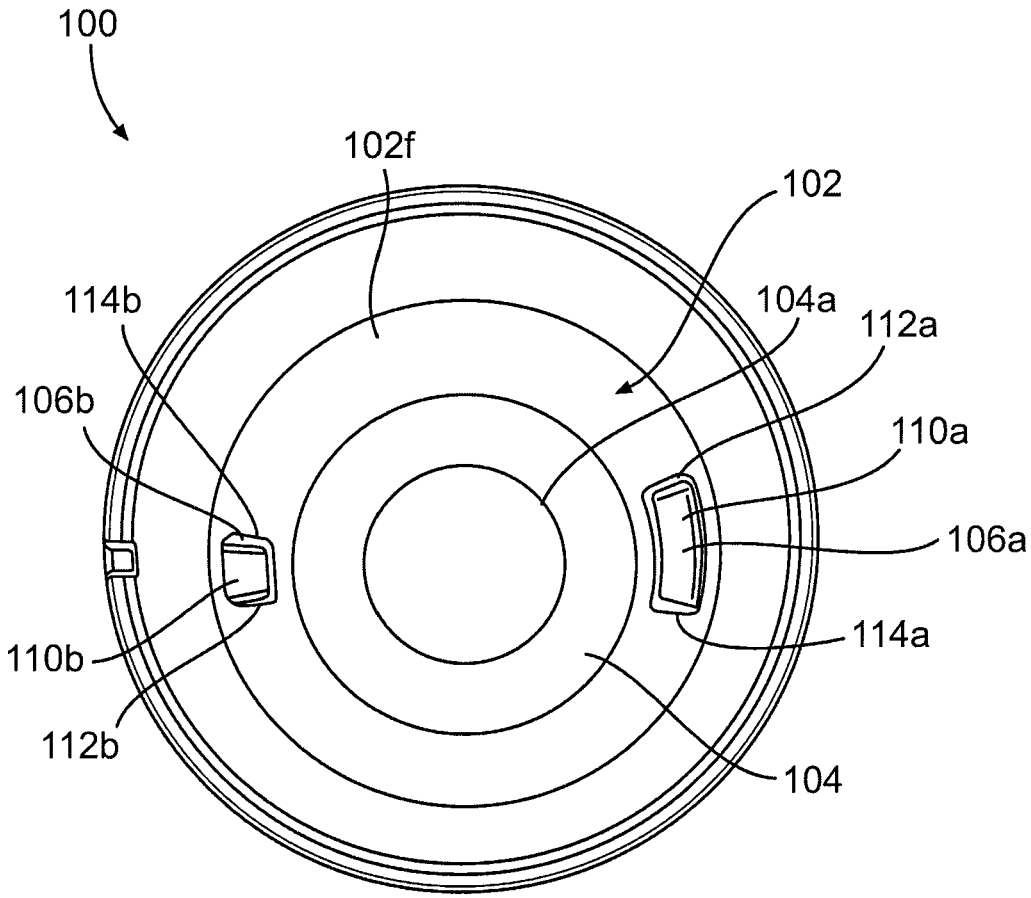
FIG. 1C is a top plan view of the reflector of FIG. 1A according to one exemplary embodiment.
Figure 1D:
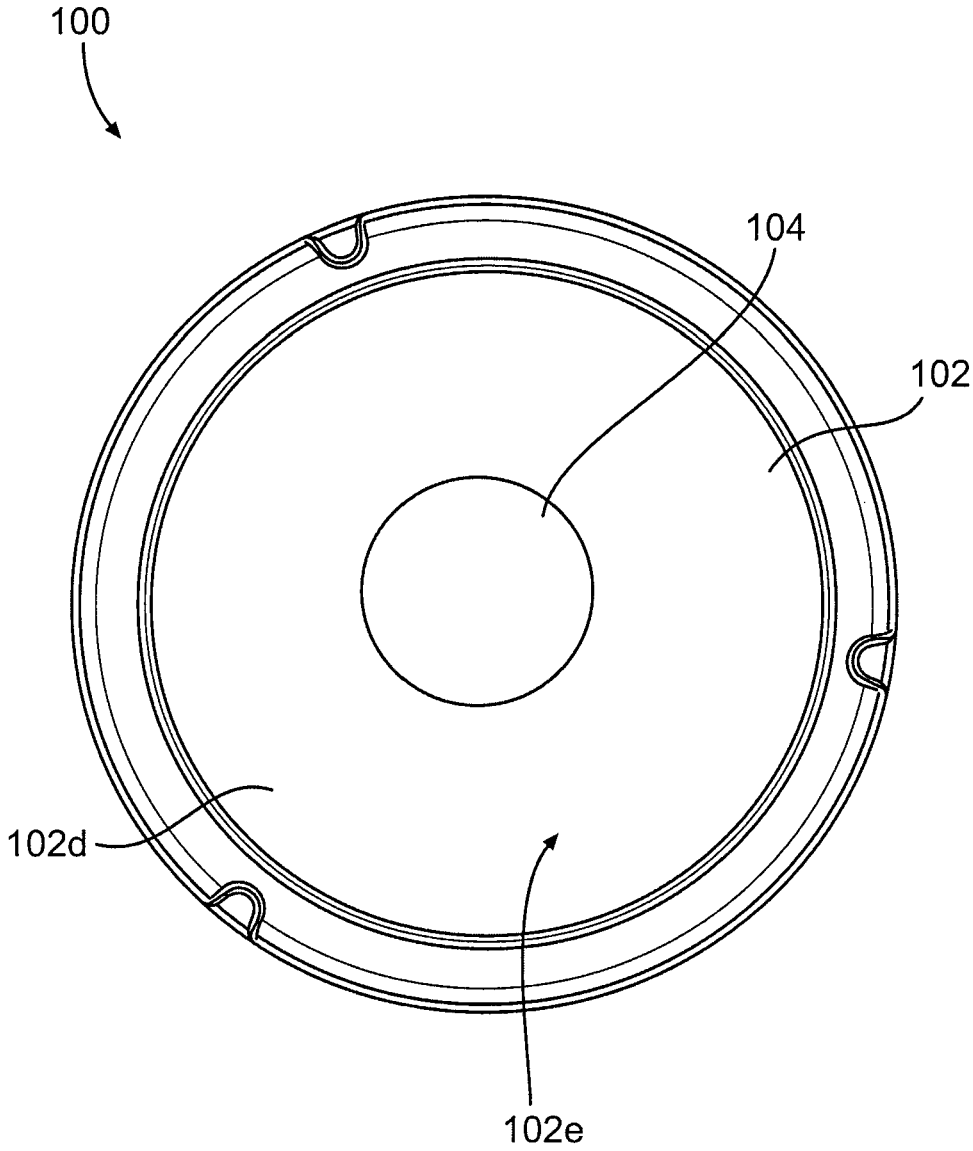
FIG. 1D is a bottom interior view of the reflector of FIG. 1A according to one exemplary embodiment.
Figure 2A:
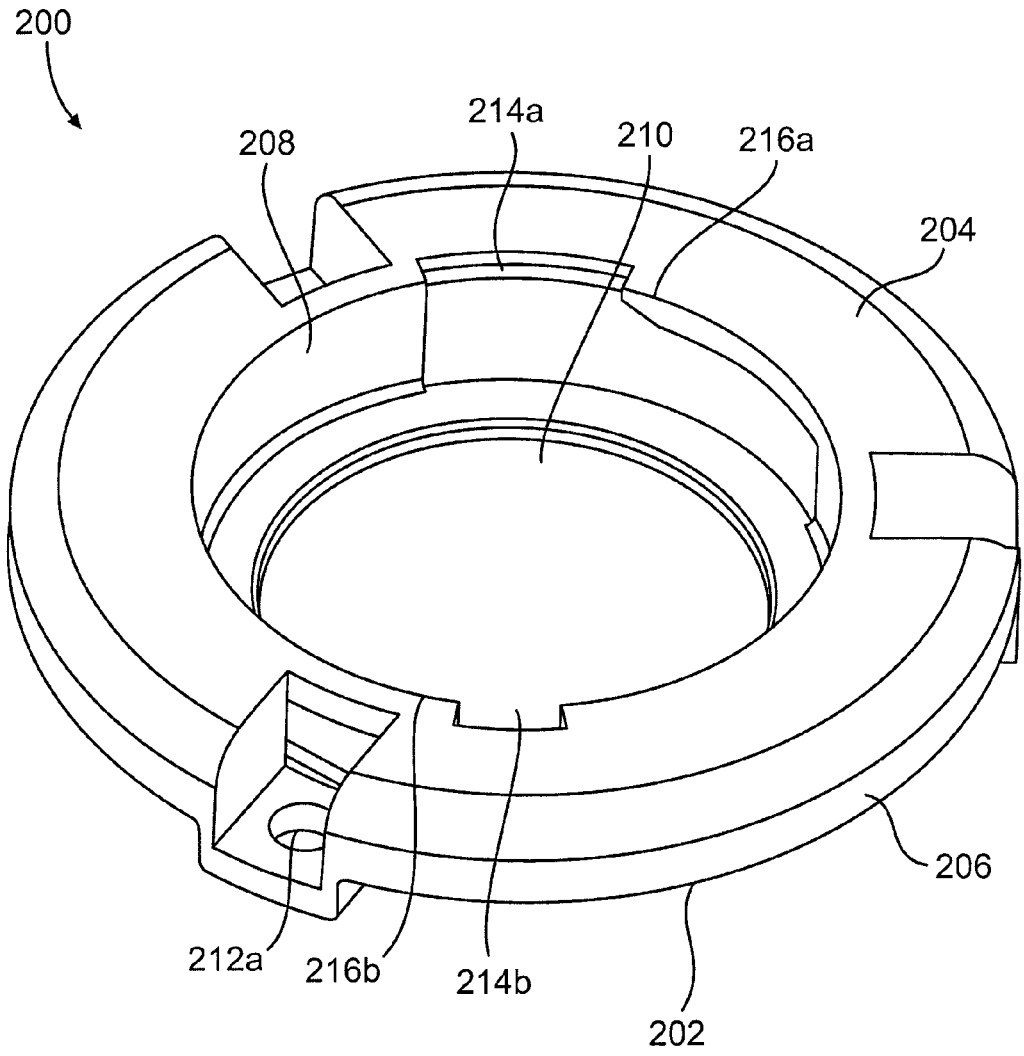
FIG. 2A is a perspective view of a reflector attachment according to one exemplary embodiment.
Figure 2B:
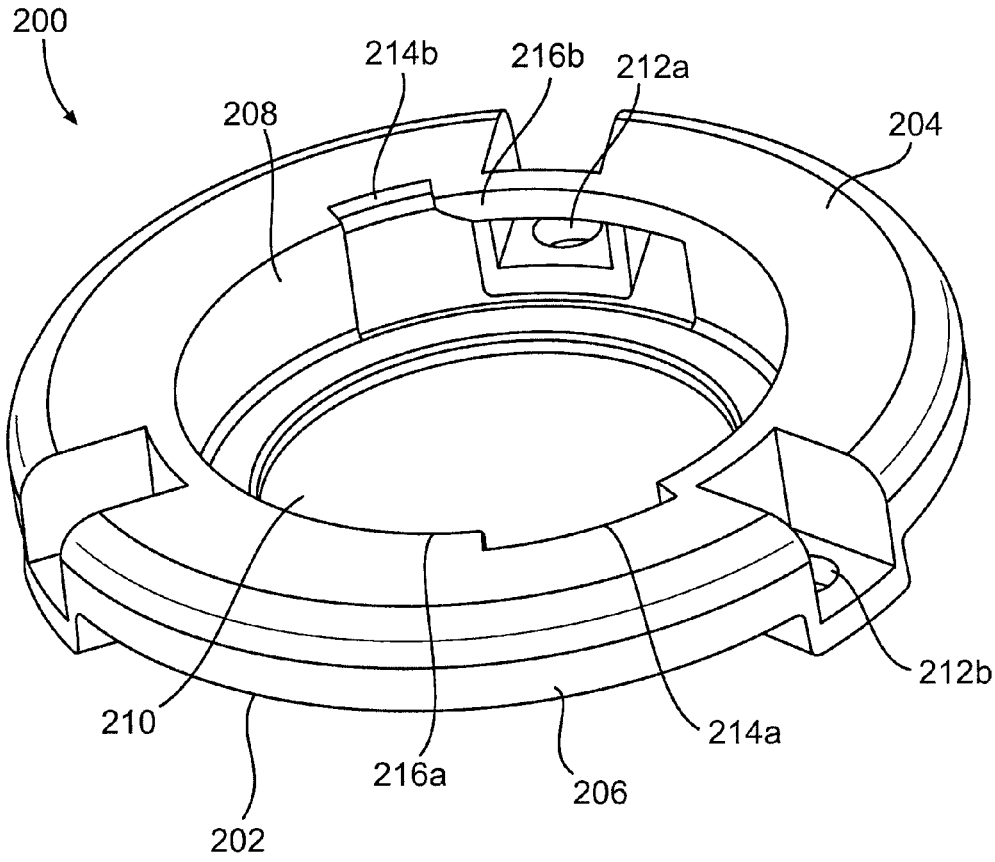
FIG. 2B is a perspective view of the reflector attachment of FIG. 2A according to one exemplary embodiment.
Figure 2C:
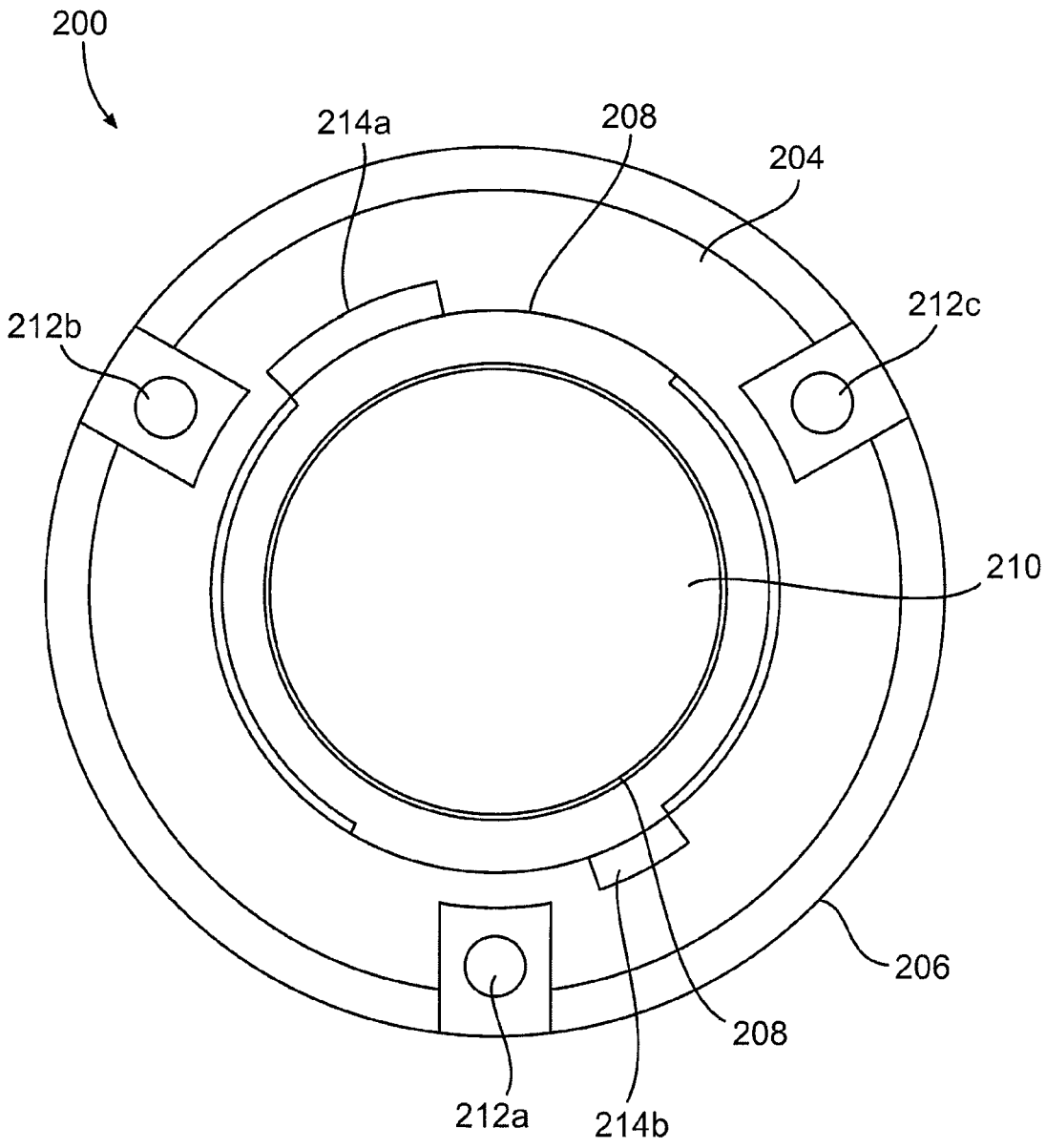
FIG. 2C is a top plan view of the reflector attachment of FIG. 2A according to one exemplary embodiment.
Figure 2D:
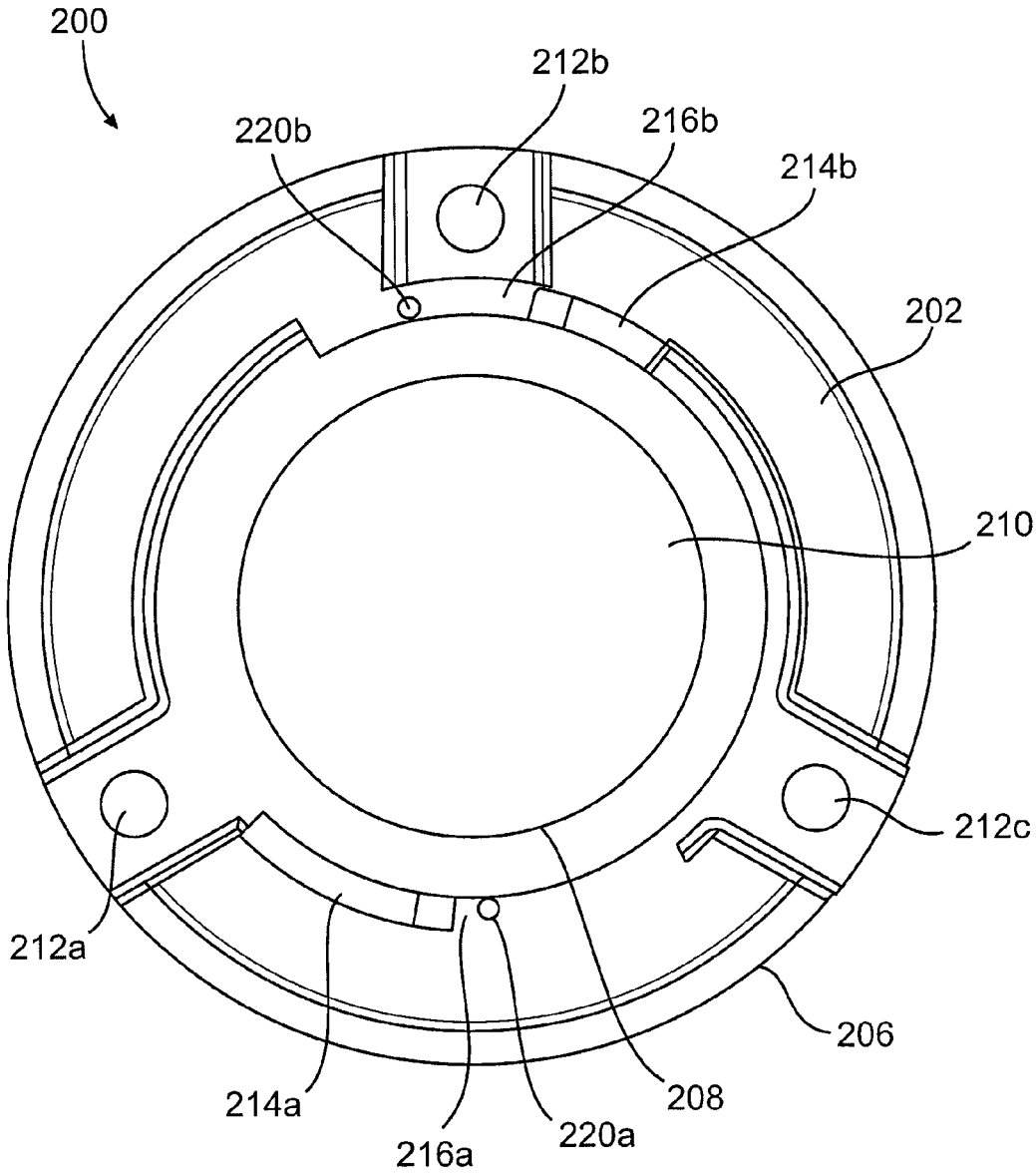
FIG. 2D is a bottom plan view of the reflector attachment of FIG. 2A according to one exemplary embodiment.

The drawings illustrate only exemplary embodiments of the invention and are therefore not to be considered limiting of its scope, as the invention may admit to other equally effective embodiments. The elements and features shown in the drawings are not necessarily to scale, emphasis instead being placed upon clearly illustrating the principles of exemplary embodiments of the present invention. Additionally, certain dimensions may be exaggerated to help visually convey such principles. In the drawings, reference numerals designate like or corresponding, but not necessarily identical, elements.

DETAILED DESCRIPTION OF THE EXEMPLARY EMBODIMENTS

The exemplary reflectors and reflector systems described herein have significant improvements over conventional reflector systems used with LED light sources. The reflectors described generally are constructed from a nonconductive material, such as borosilicate glass, and coated with a nonconductive reflective coating, are durable, and can maintain reflectivity over time without affecting the system's efficiency. The exemplary reflector systems described generally include a reflector and an attachment or adapter for allowing quick and easy removal and insertion of the reflector into the adapter, while allowing precise and consistent reflector positioning close to the LED. An exemplary reflector system also includes a media ring for quick attachment and removal of various optical filters to the light reflector. The invention may be better understood by reading the following description of non-limiting, exemplary embodiments with reference to the attached drawings wherein like parts of each of the figures are identified by the same reference characters.

FIGS. 1A-D are different views of a reflector 100 according to one exemplary embodiment. Referring to FIGS. 1A-D, the exemplary reflector 100 includes a generally frusto-conical substrate 102 integrally coupled to a circular base 104. While the exemplary substrate 102 is shown having a particular shape, the shape of the substrate 102 is not a limiting factor in the design and those of ordinary skill in the art will recognize that other shapes for the reflector substrate including, but not limited to, parabolic, conical, spherical, and free-form are within the scope and spirit of this disclosure. The substrate 102 includes a first end 102*a*, a distal second end 102*b*, and a side wall 102*c* extending between the first and second ends 102*a*, 102*b*. The base 104 is coupled to the first end 102*a* of the substrate 102, and includes an opening 104*a* through which an LED (not shown) can be positioned and can emit light. In an exemplary embodiment, the reflector 100 is a reflector glare shield that diverts incident light downward towards the target area. By directing the incident light downward, the glare shield prevents incident light from projecting upwardly and outwardly and thereby producing glare. In certain exemplary embodiments, the second end 102*b* is coupled to an optical media, the media comprising an optical filter (not shown). The side wall 102*c* includes a smooth or substantially smooth interior 102*d* defining a cavity 102*e* (FIG. 1D), and a smooth or substantially smooth exterior 102*f*. In certain alternate exemplary embodiments, the substrate 102 can have any suitable shape, such as rectangular, triangular, or oval, for use with an LED light source. In certain alternative embodiments, the interior 102*d* can include one or more facets (not shown) for mixing light emitted from an LED and/or to achieve a desired light distribution.

The reflector 100 also includes two alignment features 106*a*, 106*b* (collectively referred to herein as alignment features 106). Generally, the alignment features 106 align and hold the reflector 100 in place with respect to a reflector attachment or adapter 200 (FIGS. 1A-D). In one exemplary embodiment, the alignment features 106 are keyed so that the alignment feature 106*a* is larger in size than the alignment feature 106*b* to allow for the reflector 100 to be coupled to the reflector attachment 200 in the same position every time. In alternate embodiments, the alignment features 106 are the same size. The alignment features 106 extend from the exterior 102*f* of the substrate 102 proximate to the base 104. The alignment features 106 generally include a rectangular front wall 108*a*, 108*b* (collectively referred to herein as front walls 108), a four-sided top wall 110*a*, 110*b* (collectively referred to herein as top walls 110), a first triangular side wall 112*a*, 112*b* (collectively referred to herein as first side walls 112), and a triangular second side wall 114*a*, 114*b* (collectively referred to herein as second side walls 112). The first and second side walls 112, 114 extend orthogonally or substantially orthogonally from two opposing sides of the front wall 108 to the exterior 102*f* of the substrate 102, and the top wall 110 extends orthogonally or substantially orthogonally from the side of the front wall 108 proximate the base 104 to the exterior 102*f* of the substrate 102. The alignment features 106 also include a channel 118*a*, 118*b* (collectively referred to herein as channels 118), extending along the front wall 108 from the first side wall 112 to the second side wall 114. In certain exemplary embodiments, there are two alignment features 106 which are spaced 180 degrees apart from each other along the side wall 102*c*. Alternatively, the spacing of alignment features 106 can be more or less. For example, in one alternative embodiment (not shown), the reflector 100 contains four alignment features 106, each spaced apart 90 degrees from one another around the circumference of the exterior 102*f* of the substrate 102. In another exemplary embodiment (FIG. 4B), the reflector 100 contains three alignment features 106, each spaced apart 120 degrees from one another around the circumference of the exterior 102*f* of the substrate 102.

In certain exemplary embodiments, the reflector 100 includes a nonconductive substrate with an interior coated with a nonconductive reflective material. In certain exemplary embodiments, the interior of the substrate is coated by plasma induced chemical vapor deposition. Suitable examples of materials for constructing the substrate include, but are not limited to, glass, such as borosilicate glass or tempered soda-lime glass, and plastic, such as plastic having a low shrinkage rate to maintain the tolerances of the reflective surface. Suitable examples of nonconductive reflective materials for coating the substrate include, but are not limited to, titanium dioxide and silicon dioxide. In certain exemplary embodiments, the nonconductive reflective material is a hard coating having a reflectivity of about 95 percent or greater. In certain exemplary embodiments, the nonconductive reflective coating has color correction capabilities. In certain exemplary embodiments, the coating is a multilayer coating having two or more layers of nonconductive reflective materials. In certain exemplary embodiments, the coating modifies the correlated color temperature (CCT) and enhances the color rendering index (CRI) to tune the LED spectral distribution.

FIGS. 2A-D are different views of a reflector attachment or adapter 200 that can be used in conjunction with the reflector 100 according to one exemplary embodiment. Referring to FIGS. 2A-D, the exemplary reflector attachment 200 is ring-shaped and includes a base wall 202, an opposing distal top wall 204, an exterior side wall 206 extending from the top wall 204 to the base wall 202, an interior side wall 208 opposing the exterior side wall 206, and an opening 210 defined by the interior side wall 208. In certain exemplary embodiments, the intersection between the top wall 204 and the exterior side wall 206 is curved. The reflector attachment 200 also includes openings 212*a*, 212*b*, 212*c* (collectively referred to herein as openings 212) extending from the base wall 202 and evenly spaced apart thereon. In certain exemplary embodiments, the openings 212 are through-holes. Alternatively, the openings 212 are threaded. The openings 212 are configured to receive a fastener, such as a screw (not shown) or other coupling device for coupling the reflector attachment 200 to an LED module assembly, mounting bar, substrate, or heat sink (not shown).

In certain exemplary embodiments, the interior side wall 208 includes two notches 214*a*, 214*b* (collectively referred to herein as notches 214). In one exemplary embodiment, the shape of the notches 214 corresponds to the alignment features 106; however other shapes that are accommodated by the alignment features 106 can also be used. The exemplary interior side wall 208 also includes ledges 216*a*, 216*b* (collectively referred to herein as ledges 216). In certain exemplary embodiments, the ledges 216 are positioned adjacent to the notches 214. In those exemplary embodiments, the ledges 216 are sized to engage the channels 118 of the alignment features 106. Retaining elements, such as grip elements 220*a*, 220*b* (collectively referred to herein as grip elements 220 shown in FIG. 2D) are present on an underside surface of the ledges 216. In certain exemplary embodiments, the grip elements 220 are protrusions, bumps, or detents. The alignment features 106 can be inserted into the corresponding notches 214 and the ledges 216 engage the channels 118 upon rotation of the reflector 100. The reflector 100 can be held in place in the reflector attachment 200 by applying enough force to rotate the alignment features 106 past the grip elements 220. To remove the reflector 100 from the reflector attachment 200, the reflector 100 must be rotated with enough force applied to overcome the force of the grip elements 220.

Figure 3:
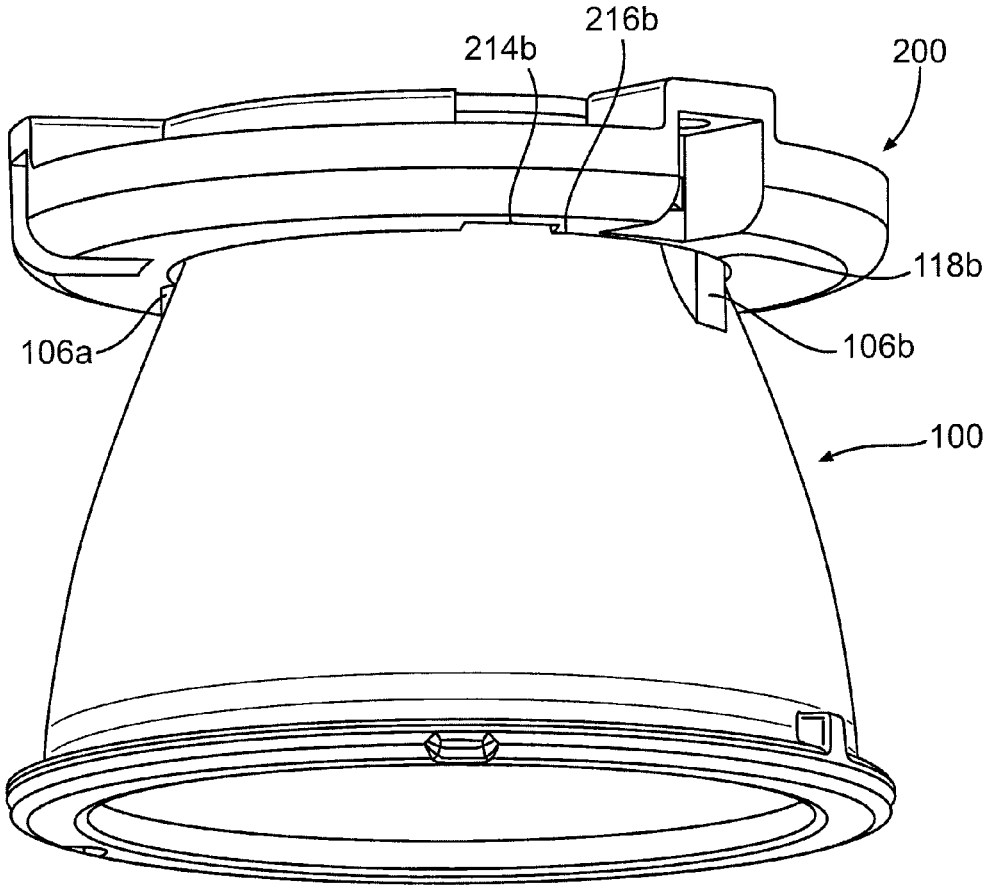
FIG. 3 is a perspective side view of the reflector of FIG. 1A coupled to the reflector attachment of FIG. 2A according to one exemplary embodiment.

FIG. 3 is a perspective side view of the reflector 100 (FIGS. 1A-D) coupled to the reflector attachment 200 (FIGS. 2A-D) according to one exemplary embodiment. The alignment features 106 are inserted into the corresponding notches 214 and rotated so that the ledges 216 engage the channels 118 of the alignment features 106 of the reflector 100.

Figure 4A:
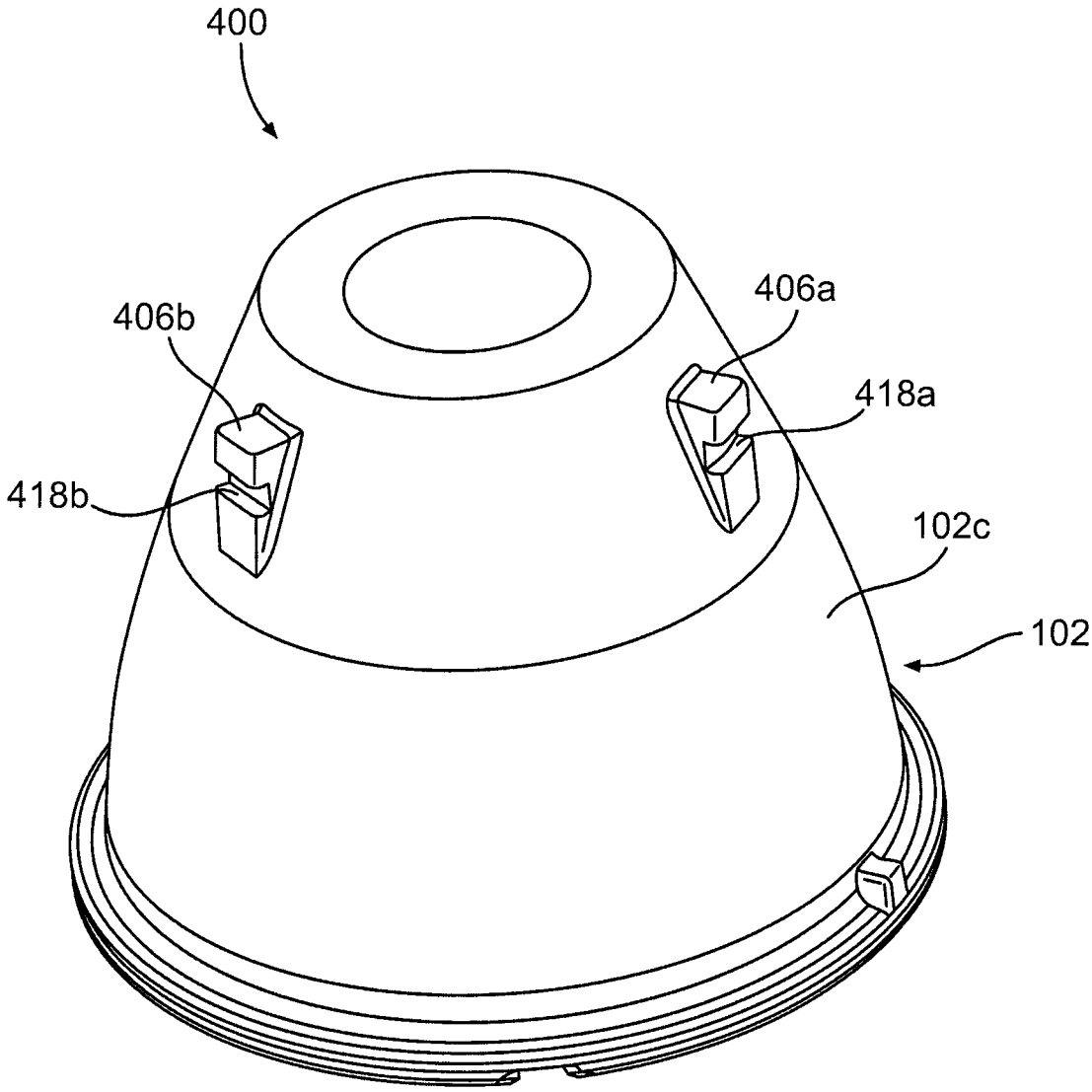
FIG. 4A is a perspective view of a reflector according to an exemplary embodiment.
Figure 4B:
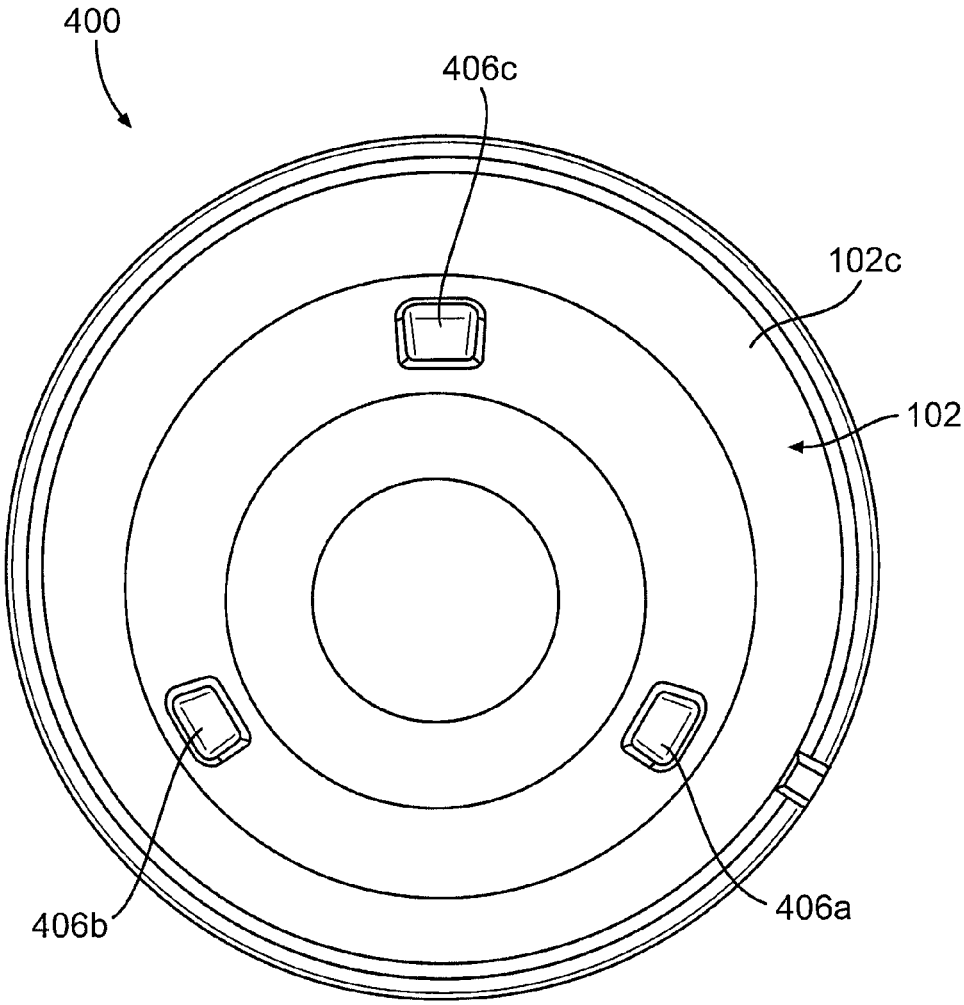
FIG. 4B is a top plan view of the reflector of FIG. 4A according to one exemplary embodiment.

FIG. 4A is a perspective view of a reflector 400 according to one exemplary embodiment. FIG. 4B is a top plan view of the exemplary reflector 400. The reflector 400 is the same as that described above with regard to FIGS. 1A-D, except as specifically stated below. For the sake of brevity, the similarities will not be repeated hereinbelow.

The reflector 400 includes three alignment features 406*a*, 406*b*, 406*c* (collectively referred to herein as alignment features 406). In one exemplary embodiment, the alignment features 406 are sized and shaped the same. Alternatively, the alignments features can have different sizes or shapes to "key" the reflector sides to certain grooves in the attachment. The alignment features 406 also include channels 418*a*, 418*b*, 418*c* (collectively referred to herein as channels 418) similar to channels 118. In certain exemplary embodiments, the alignment features 406 are spaced 120 degrees apart from each other along the side wall 102*c* of the substrate 102. In an alternate embodiment, the alignment features 406 can be spaced apart at distances other than 120 degrees, even or uneven, from each other along the side wall 102*c* of the substrate 102. In alternate embodiments, greater or less numbers of alignment features 406 can be utilized and the spacing between those alignment features 406 can be even or uneven along the side wall 102*c*.

Figure 5A:
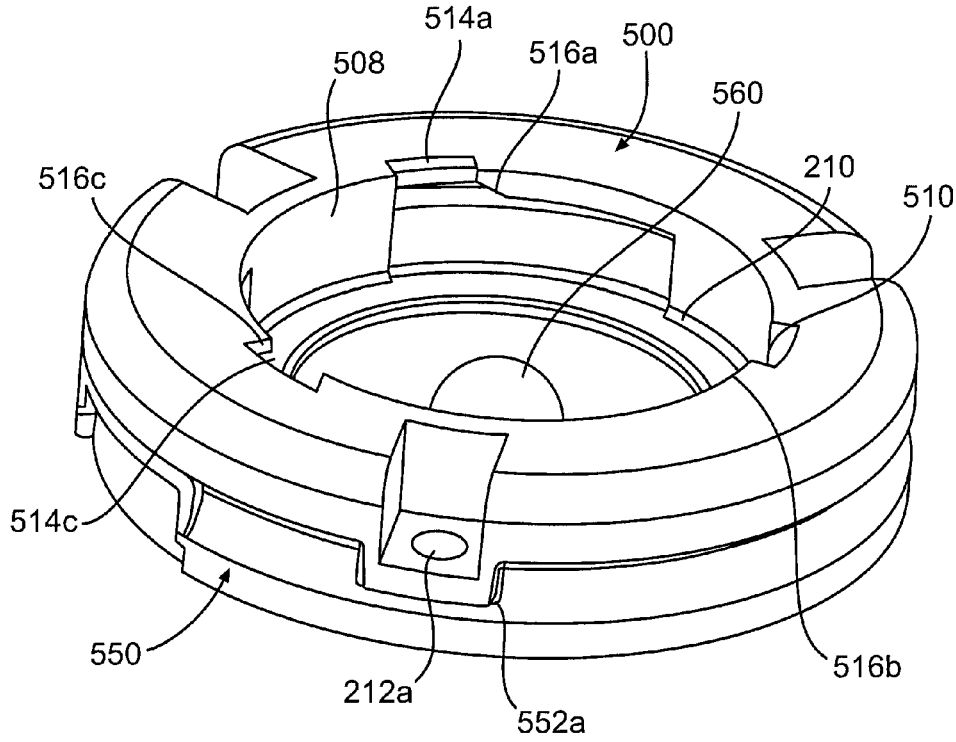
FIG. 5A is a perspective view of a reflector attachment coupled to an LED module assembly according to an exemplary embodiment.
Figure 5B:
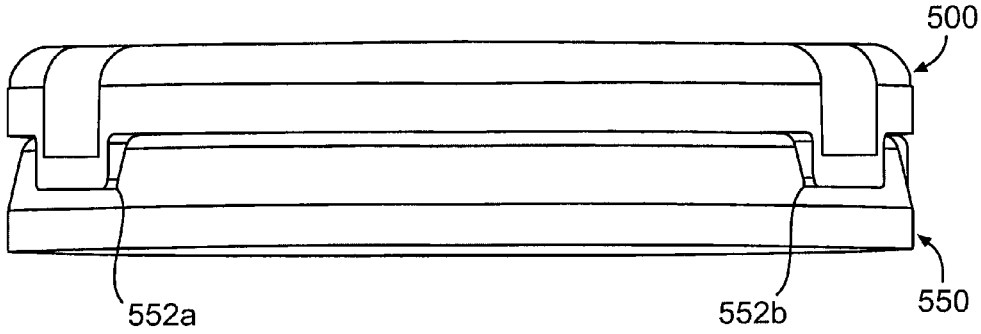
FIG. 5B is a side view of the reflector attachment coupled to the LED module assembly of FIG. 5A according to one exemplary embodiment.
Figure 5C:
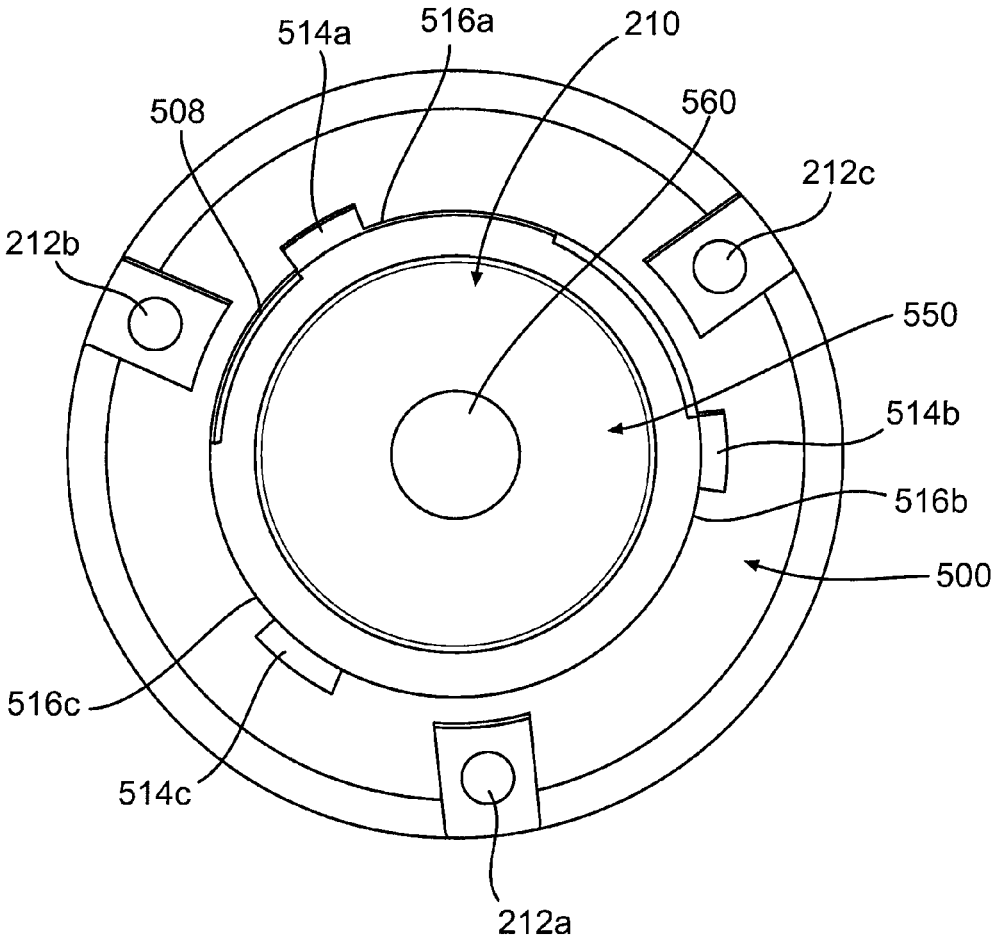
FIG. 5C is a top plan view of the reflector attachment coupled to the LED module assembly of FIG. 5A according to one exemplary embodiment.

FIG. 5A-C are different views of a reflector attachment 500 coupled to an LED module assembly, mounting bar, substrate or heat sink (collectively referred to herein as a LED module assembly 550) according to one exemplary embodiment. In certain exemplary embodiments, the reflector 500 is the same as that described above with regard to FIGS. 2A-D, except as specifically stated below. For the sake of brevity the similarities will not be repeated hereinbelow.

As illustrated in FIG. 5A, an interior side wall 508 of the reflector attachment 500 includes three notches 514*a*, 514*b*, 514*c* (collectively referred to herein as notches 514). The shapes of the notches 514 correspond to the alignment features 406. The interior side wall 508 also includes three ledges 516*a*, 516*b*, 516*c* (collectively referred to herein as ledges 516) adjacent to the notches 514. The ledges 516 are sized to engage channels 418 of the alignment features 406. The alignment features 406 can be inserted into the corresponding notches 514 and the ledges 516 engage the channels 418 upon rotation of the reflector 400.

The reflector attachment 500 can be coupled to the LED module assembly 550 by seating the openings 212 into corresponding grooves 552*a*, 552*b*, 552*c* (collectively referred to herein as grooves 552) and securing the reflector attachment 500 to the LED module assembly 550 with fasteners, such as screws (not shown). The LED module assembly 550 also includes an LED light source 560 positioned in a center thereof, where the LED light source 560 emits light through the opening 210 when coupled to the reflector 500. In certain exemplary embodiments, the LED light source 560 can be a discrete LED die, and array of LEDs, or a chip-on-board LED module. Further, the exemplary LED light source 560 can include LEDs emitting light in one color or more than one color. For example, a portion of the LEDs in the LED light source 560 can emit white light and another portion can emit non-white light. Examples of non-while light emitting LEDs include red, green, blue or amber LEDs.

Figure 6:
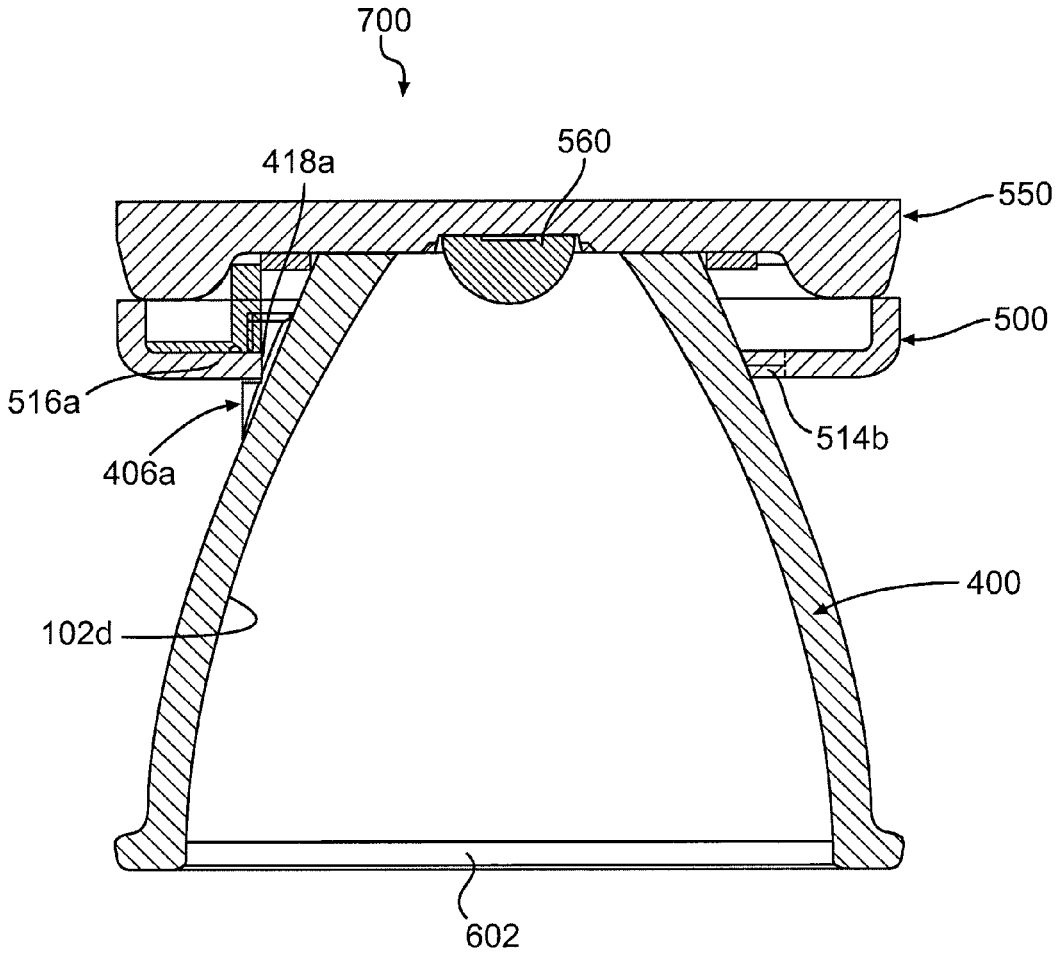
FIG. 6 is a side cross-sectional view of the reflector of FIG. 4A coupled to the reflector attachment and LED module assembly of FIG. 5A according to one exemplary embodiment.

FIG. 6 is a side cross-sectional view of the reflector 400 (FIGS. 4A-B) coupled to the reflector attachment 500 and LED module assembly 550 (FIGS. 5A-C) according to one exemplary embodiment. The alignment features 406 are inserted into the corresponding notches 514 and rotated so that the ledges 516 engage the channels 418 of the alignment features 406 of the reflector 400. Light from the LED light source 560 is emitted and reflected off of the interior 102*d* of the reflector 400, and through a reflector exit aperture 602.

Figure 7:
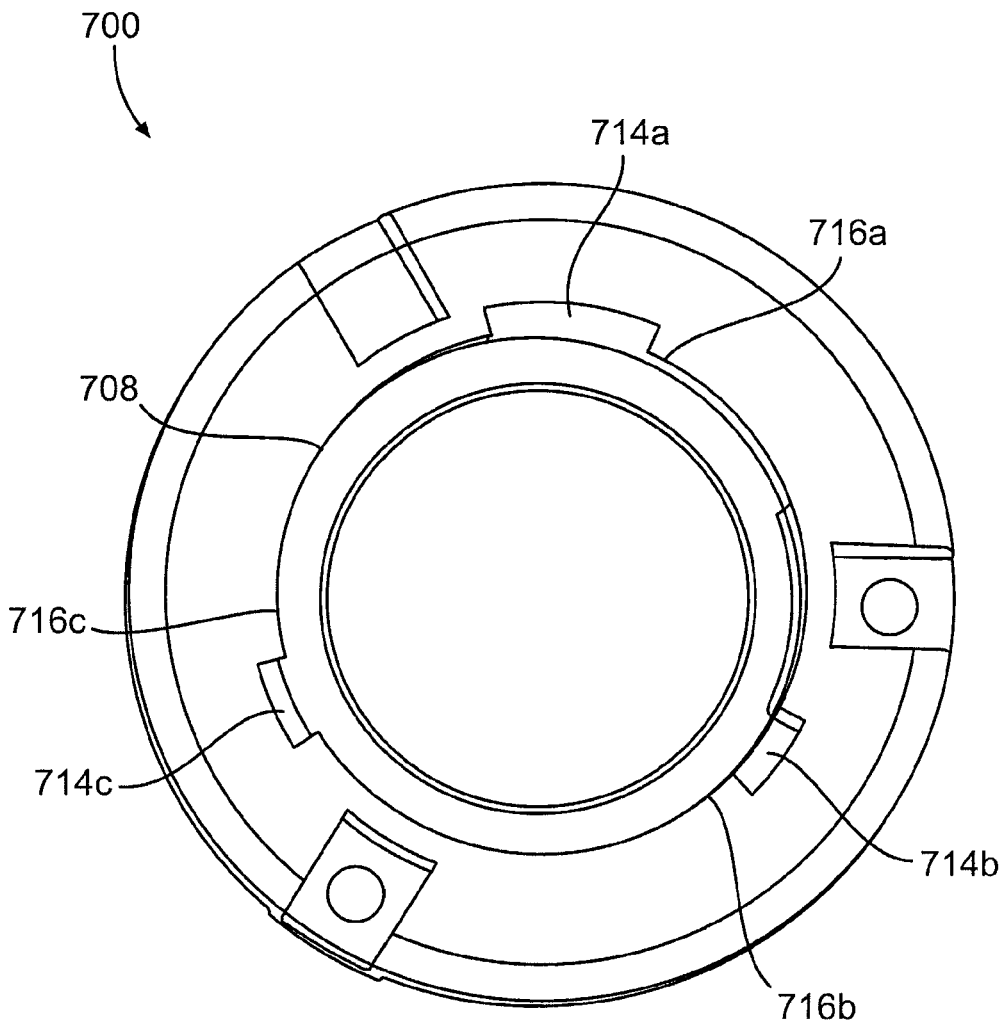
FIG. 7 is a top plan view of a reflector attachment according to an exemplary embodiment.

FIG. 7 is a top plan view of a reflector attachment 700 according to one exemplary embodiment. In certain exemplary embodiments, the reflector 700 is the same as that described above with regard to FIGS. 2A-D, except as specifically stated below. For the sake of brevity the similarities will not be repeated hereinbelow.

An interior side wall 708 of the reflector attachment 700 includes three notches 714*a*, 714*b*, 714*c* (collectively referred to herein as notches 714). The shapes of the notches 714 correspond to the alignment features 406 (FIGS. 4A-B), with the exception that notch 714*a* is larger than notches 714*b*, 714*c*. The reflector attachment 700 can be used in conjunction with the reflector 400 (FIGS. 4A-B) or with a reflector (not shown) having alignment features that are keyed to correspond to the notches 714 to control reflector orientation. The interior side wall 208 also includes three ledges 716*a*, 716*b*, 716*c* (collectively referred to herein as ledges 716) adjacent to the notches 714. The ledges 716 are sized to engage channels 418 of the alignment features 406. The alignment features 406 can be inserted into the corresponding notches 714 and the ledges 716 engage the channels 418 upon rotation of the reflector 400.

FIGS. 8A-D provide various views of a reflector attachment 800 according to an exemplary embodiment. In certain exemplary embodiments, the reflector attachment 800 is the same as that described above with regard to FIGS. 2A-D, except as specifically stated below. For the sake of brevity the similarities will not be repeated hereinbelow.

An interior side wall 808 of the reflector attachment 800 includes two notches 814*a* and 814*b* (collectively referred to herein as notches 814). The shapes of the notches 814 correspond to the alignment features 106 (FIGS. 1A-D), however other shapes that are accommodated by the alignment features 106 can also be used. The exemplary reflector attachment includes a top wall 804 including ledges 816*a* and 816*b* (collectively referred to herein as ledges 816). Ledges 816 extend from the top wall 804 in the direction towards the interior side wall 808. In an exemplary embodiment, the ledges 816 are positioned adjacent to the notches 814 and are sized to engage the channels 118 of the alignment features 106. The alignment features 106 can be inserted into the corresponding notches 814 and the ledges 816 engage the channels 118 upon rotation of the reflector 100. The exemplary ledges 816 are flexible in the direction perpendicular to the surface of the top wall 804. In an exemplary embodiment, the ledges 816 flex to engage the channels 118 of the alignment features 106. In an exemplary embodiment, the bottom surface of the ledges 816 can exert pressure on the channels 118 to hold the reflector 100 in place.

Figure 8A:
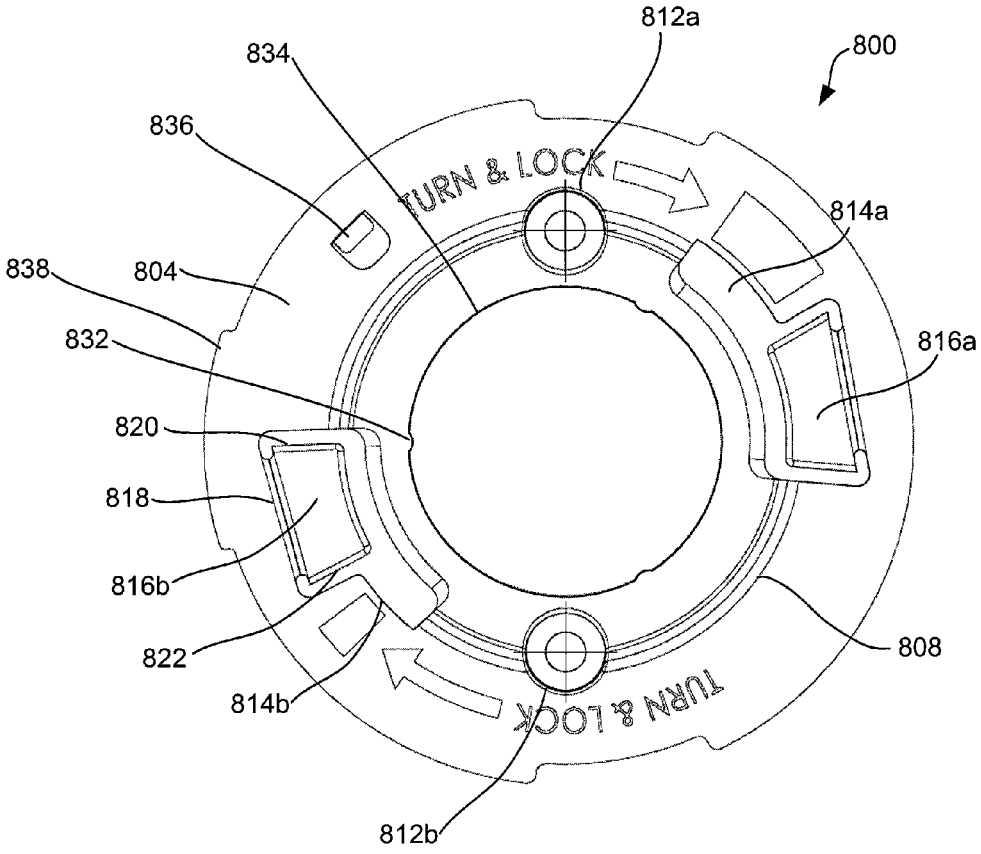
FIG. 8A is a top plan view of a reflector attachment according to an exemplary embodiment.
Figure 8B:
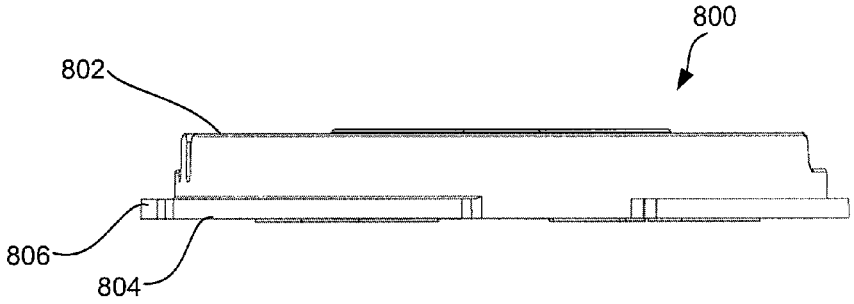
FIG. 8B is a side view of the reflector attachment of FIG. 8A according to one exemplary embodiment.
Figure 8C:
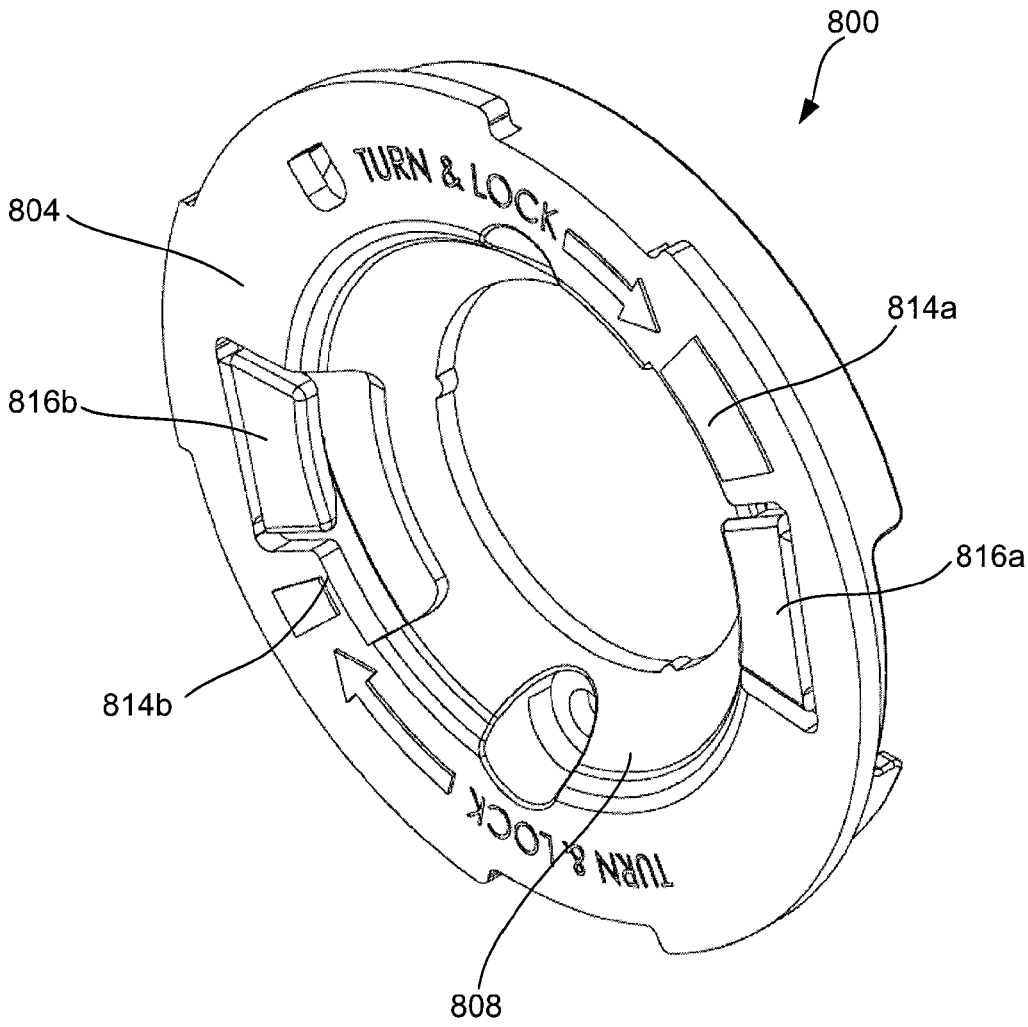
FIG. 8C is a perspective view of the reflector attachment of FIG. 8A according to one exemplary embodiment.

In an exemplary embodiment, the ledges 816 are anchored to the top wall 804 at only one edge in a cantilever fashion. As illustrated in FIG. 8A, the ledges 816 can be anchored to the top wall 804 at base edge 818 parallel to the outer circumference of the reflector attachment 800. Alternatively, the ledges 816 can be anchored to the top wall 804 at one of side edges 820 and 822. In an alternate embodiment (not shown), the ledges 816 can be anchored to the top wall 804 at one or more of base edge 818, side edge 820, and side edge 822. In an exemplary embodiment, the exterior edges of ledges 816 can include a chamfer and/or rounded edge surface. Ledges 816 can be the same thickness as the top wall 804. In an alternate embodiment, ledges 816 are varying thickness, being thicker at the end anchored to the top wall 804. In an alternate embodiment, the ledges 816 can be thicker at the end opposite the anchored end to engage the channels 118 of the alignment features 106.

In certain exemplary embodiments, reflector attachment 800 may include an alignment feature for centering the reflector attachment 800 on the reflector 100. These alignment features can include, for example, nodules 832 extending from the interior side wall 834 of the reflector. The size, shape, and spacing of the nodule 832 may be such that the exterior surface 102*f* of the reflector 100 engages the nodules 832 and centers the reflector 100 in the reflector attachment 800. In exemplary embodiments, the nodules 832 can have a round/curved, geometric, and/or any other shape for retaining the reflector 100. For example, as illustrated in FIG. 8A, the nodules 832 can have a round shape.

In certain exemplary embodiment, reflector attachment 800 can include an alignment feature for aligning the reflector attachment 800 on the LED module (see FIG. 5B, 550). The LED module alignment features can include, for example, a projection 836 from the top wall 804 of the reflector attachment 800. The projection 836 can extend from the top wall 804 in a direction towards the base wall 802. The projection 836 can extend in the direction orthogonal or substantially orthogonal to the top wall 804 in the direction of the base wall 802. The projections can be formed from a portion of the top wall 804 that is bent or otherwise formed to extend in the direction of the base wall 802. For example, the projection 836 can be punched from the top wall 804 and bent downward toward the base wall 802. In an exemplary embodiment, the projection 836 is sized and shaped to engage a corresponding depression on the LED module assembly (not shown). Accordingly, when the LED module is coupled to the reflector attachment 800, the protection 836 mates with the corresponding depression on the LED module to ensure correct orientation of the openings 812*a*, 812*b* on the reflector attachment 800 with the LED module.

In an exemplary embodiment, the reflector attachment 800 includes a tongue 838 to align the reflector attachment 838 with the LED module assembly, mounting bar, substrate, or heat sink. The tongue 838 extends from the top wall 804 in a direction parallel and/or concurrent with the surface of the top wall 804. An exemplary tongue 838 extends beyond the outer surface of the exterior side wall 806 and engages an interior surface of the LED module assembly, mounting bar, substrate, heat sink, and/or other device to which the reflector attachment 800 is mating.

Figure 8D:
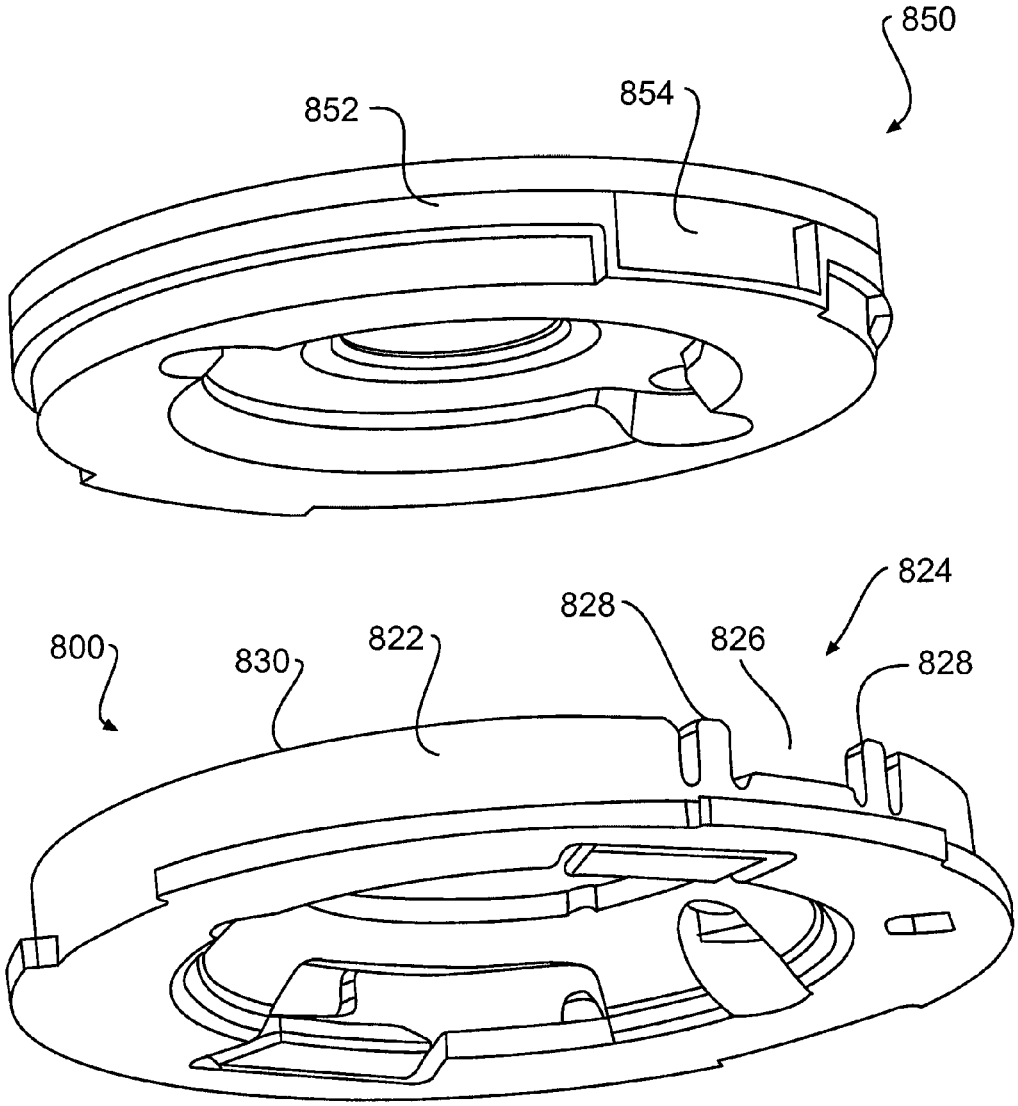
FIG. 8D is a perspective view of the reflector attachment of FIG. 8A according to one exemplary embodiment.

FIG. 8D is a perspective view of the reflector attachment 800 according to an exemplary embodiment and a LED module 850. The exemplary reflector attachment 800 includes an exterior side wall 822. In certain exemplary embodiments, the exterior side wall 822 may include notch 824 defining an opening 826. The opening 826 may be sized and shaped to accommodate a wiring connector (FIG. 8D, 870). The notch 824 may include retaining members 828 extending from a bottom surface of the notch 824. The size, shape, and spacing of the retaining members 828 may be such that a wiring connector 870 can be restrained within the surface defined by the interior side wall (not shown) of the reflector attachment 800 by the retaining members 828. In an exemplary embodiment, the retaining members 828 extend to the surface defined by the bottom wall 830 of the exterior side wall 822. In an alternate embodiment, the retaining members 828 to extend beyond the surface defined by the bottom wall 830. In a further exemplary embodiment, the retaining members 828 do not extend to the surface defined by the bottom wall 830. In certain exemplary embodiments, the retaining members 828 can be removed, e.g., broken off, completely or partially to accommodate different size and shape connectors. In an alternate embodiment, the notch 824 does not include the retaining members 828 and is constructed as a single opening in the exterior side wall 822.

In certain exemplary embodiment, the interior side wall of the reflector attachment matingly engages an exterior wall 852 of the LED module 850. An exemplary LED module may include a socket 854 for receiving an electrical connector 870 for providing power and control signals to the LED driver within the LED module 850.

Figure 8E:
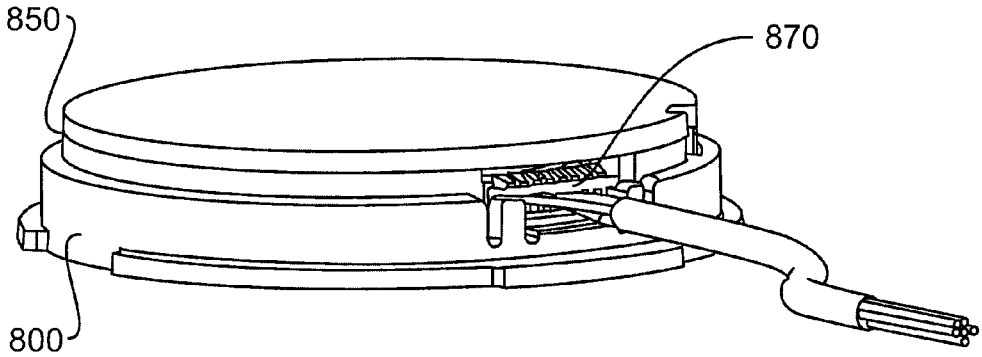
FIG. 8E is a perspective view of the reflector attachment of FIG. 8A and a LED module according to one exemplary embodiment.

As illustrated in FIG. 8E, when assembled, the opening 826 of the reflector attachment 800 and the socket 854 of the LED module 850 aligned to receive the connector 870. In an exemplary embodiment, the connector 870 is mated with the socket 854. The LED module 850 and connector 870 pair are then lowered onto the reflector attachment 800. The retaining members 828 of the reflector attachment 800 retain the connector 870 within the socket 870.

Figure 9:
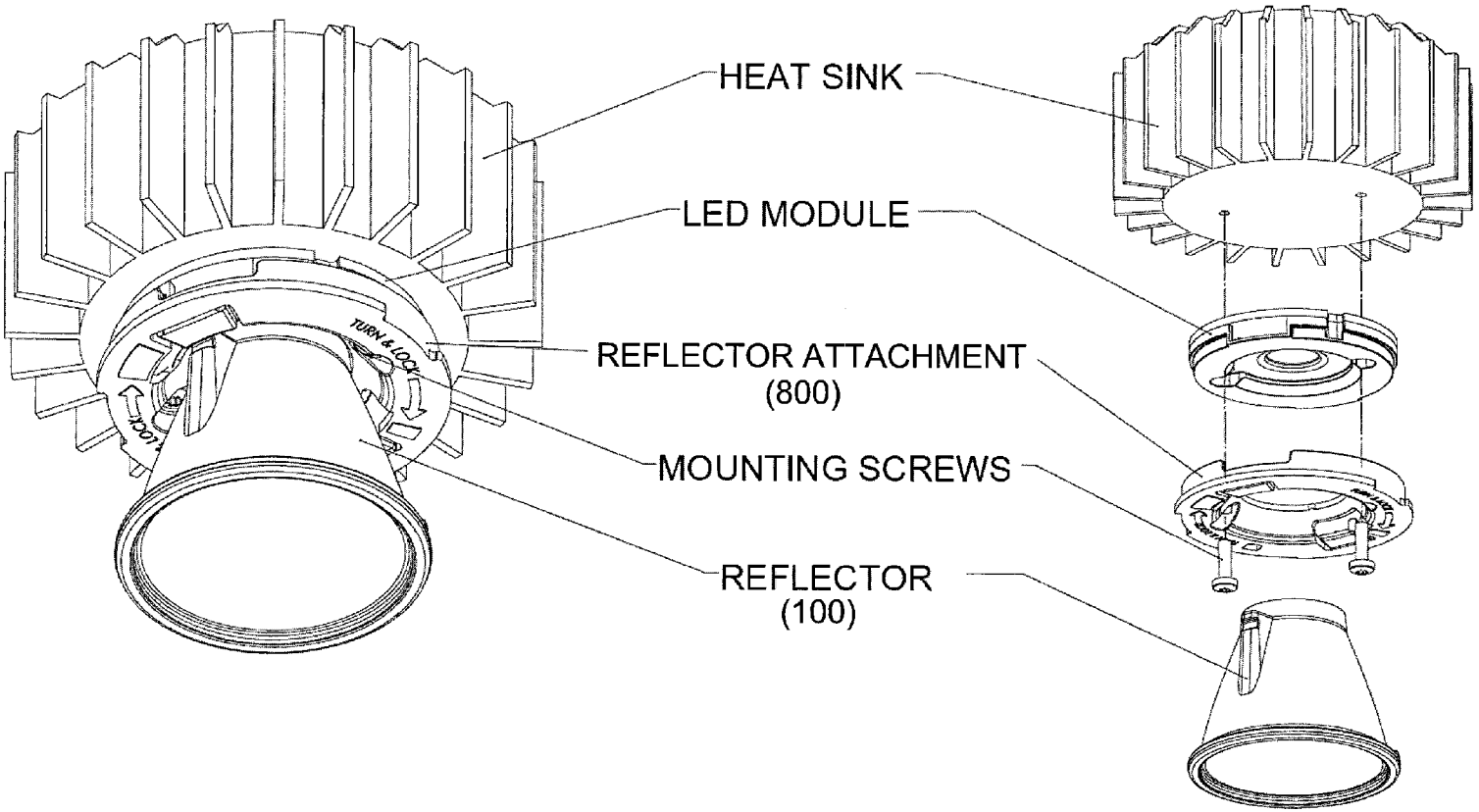
FIG. 9 is an exploded perspective view of a reflector, reflector attachment, LED module, and heat sink according to an exemplary embodiment.

FIG. 9 is a perspective view of the reflector 100 (FIGS. 1A-D) coupled to the reflector attachment 800 (FIGS. 8A-E) according to one exemplary embodiment. The alignment features 106 are inserted into the corresponding notches 814 and rotated so that the ledges 816 engage the channels 118 of the alignment features 106 of the reflector 100. Mounting screws couple the reflector attachment 800 and the LED module to the heat sink. In an exemplary embodiment, the mounting openings on the reflector attachment 800 and/or the LED module can include threads or can include non-threaded through holes.

Figure 10A:
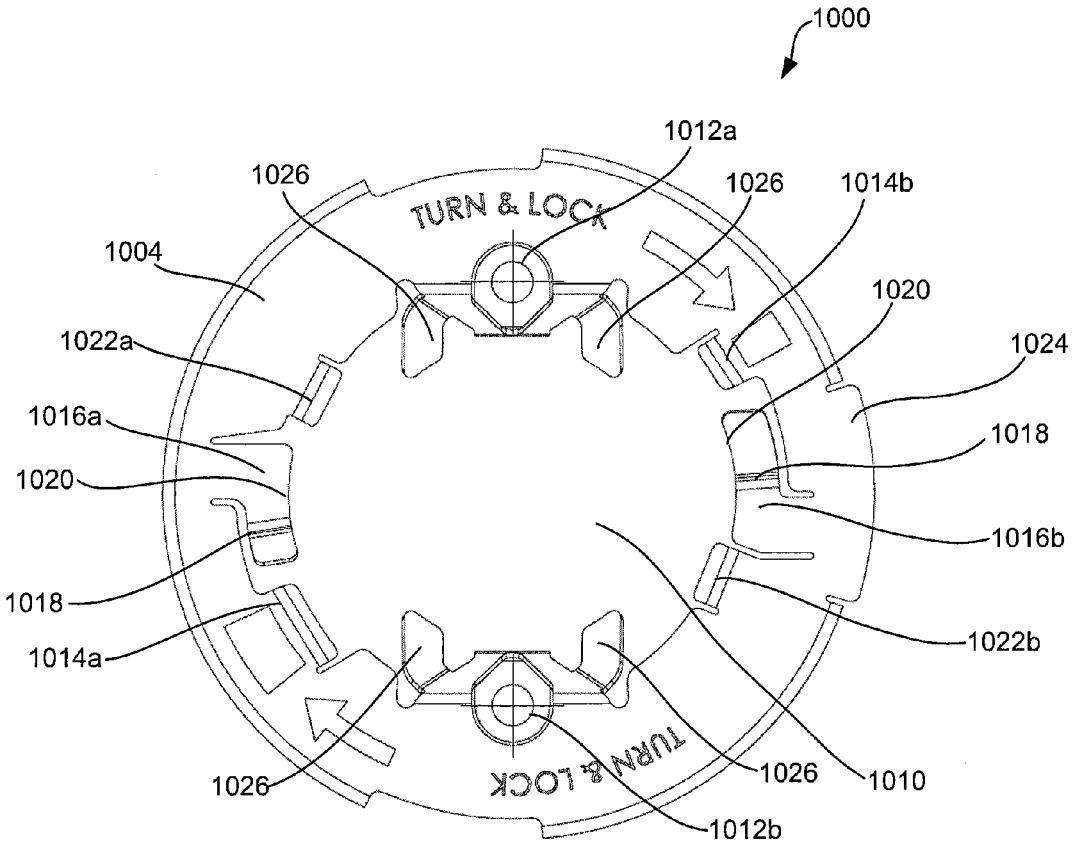
FIG. 10A is a top plan view of a reflector attachment according to an exemplary embodiment.
Figure 10B:
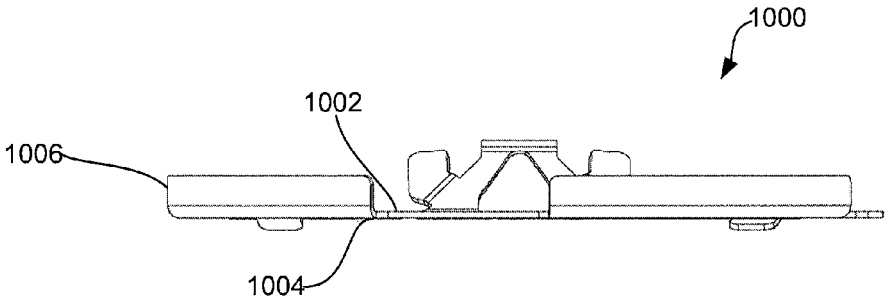
FIG. 10B is a side view of the reflector attachment of FIG. 10A according to one exemplary embodiment.
Figure 10C:
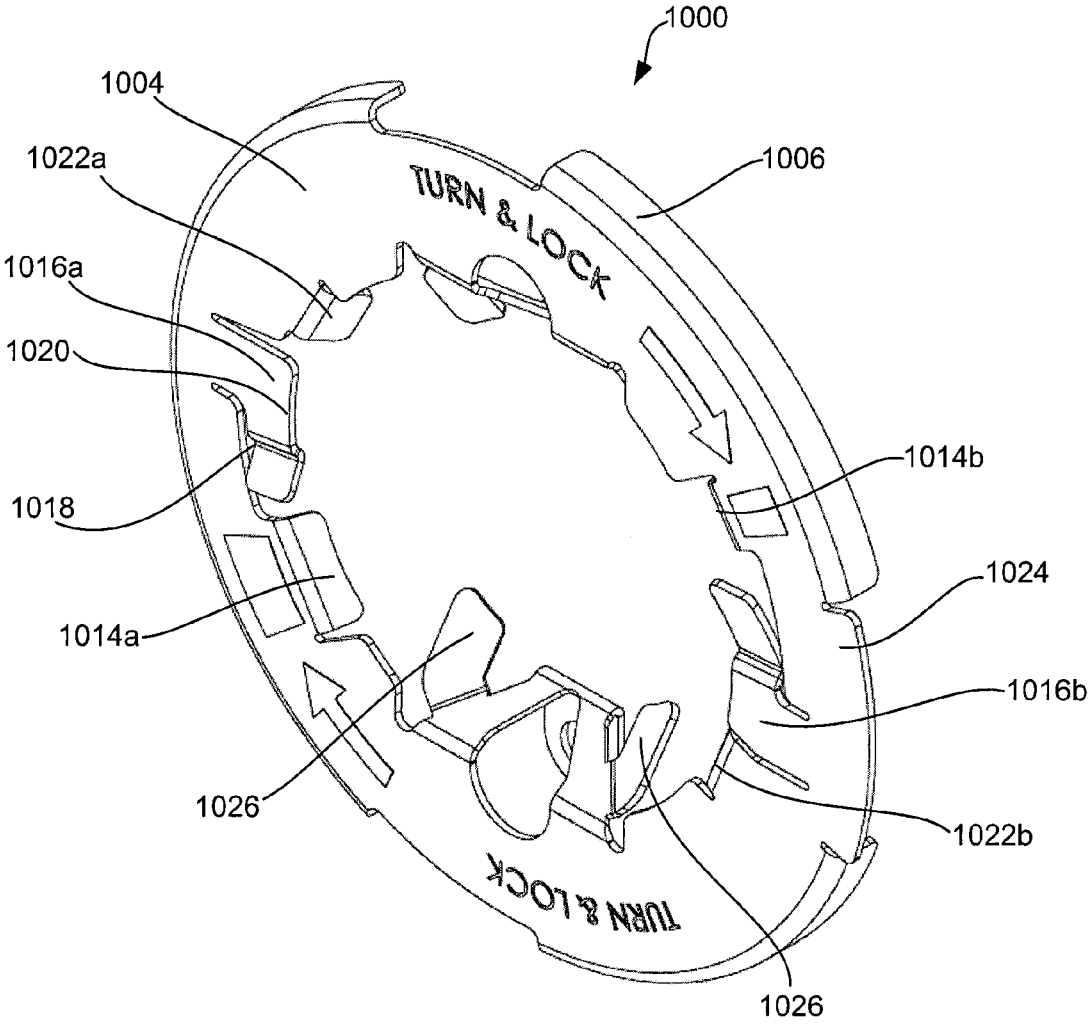
FIG. 10C is a perspective view of the reflector attachment of FIG. 10A according to one exemplary embodiment.

FIGS. 10A-C provide various views of a reflector attachment 1000 according to an exemplary embodiment. The exemplary reflector attachment 1000 can be constructed from metal such as spring steel, stainless steep, or the like. In certain exemplary embodiments, the reflector attachment 1000 is the same as that described above with regard to FIGS. 2A-D, except as specifically stated below. For the sake of brevity the similarities will not be repeated hereinbelow.

As illustrated in FIGS. 10A-C, the exemplary reflector assembly 1000 is ring-shaped and includes a base wall 1002, an opposing distal top wall 1004, an exterior side wall 1006 extending from the top wall 1004 in the direction of the base wall 1002, and an opening 1010 defined by the center opening of the reflector assembly 1000. In certain exemplary embodiments, the intersection between the top wall 1004 and the exterior side wall 1006 is curved. In an alternate embodiment, the intersection between the top wall 1004 and the exterior side wall 1006 is chamfered.

The reflector attachment 1000 also includes openings 1012*a* and 1012*b* (collectively referred to herein as openings 1012) extending from the base wall 1002 and evenly spaced apart thereon. In certain exemplary embodiments, the openings 1012 are through-holes. The openings 1012 are configured to receive a fastener, such as a screw (not shown) or other coupling device for coupling the reflector attachment 1000 to an LED module assembly, mounting bar, substrate, or heat sink (not shown). The size, shape, and spacing of the alignment tabs 1026 such that the exterior surface 102*f* of the reflector 100 engages the alignment tabs 1026 and centers the reflector 100 in the reflector attachment 1000. In an exemplary embodiment, the openings 1012 are flanked on each side with alignment tabs 1026. When coupled, tabs 1026 align openings 1012 of the reflector attachment 1000 with the corresponding coupling point in the LED module assembly, mounting bar, substrate, or heat sink.

In certain exemplary embodiments, the top wall 1004 includes two notches 1014*a* and 1014*b* (collectively referred to herein as notches 1014). In one exemplary embodiment, the shape of the notches 1014 corresponds to the alignment features 106 (FIGS. 1A-D), however other shapes that are accommodated by the alignment features 106 can also be used. As illustrated in FIGS. 10A and 10C, notches 1014 can include a downward facing tabs that engage the channels 118 of the alignment features 106. The tabs extend in the direction orthogonal or substantially orthogonal to the top wall 1004 in the direction of the base wall 1002. The downward facing tabs can be formed from a portion of the top wall 1004 that is bent or otherwise formed to extend in the direction of the base wall 1002.

The top wall 1004 of the exemplary reflector attachment 1000 includes ledges 1016*a* and 1016*b* (collectively referred to herein as ledges 1016). Ledges 1016 extend from the top wall 1004 in a direction toward opening 1010. In an exemplary embodiment, the ledges 1016 are positioned adjacent to the notches 1014 and are sized to engage the channels 118 of the alignment features 106. The alignment features 106 can be inserted into the corresponding notches 1014 and the ledges 1016 engage the channels 118 upon rotation of the reflector 100.

As illustrated in FIGS. 10A and 10D, the exemplary ledges 1016 can be formed as L-shaped extensions from the top wall 1004. In an exemplary embodiment, ledges 1016 can include an angular or V-shaped bend 1018 to provide ledges 1016 flexibility in the direction perpendicular or substantially perpendicular to the top wall 1004. The reflector 100 can be held in place in the reflector attachment 1000 by rotating the alignment features 106 to engage the ledges 1016. The angular or V-shaped bend can cause ledge 1016 to flex along the length of ledge 1016 that engages the channels 118. For example, the ledge 1016 can flex along the length of the bottom edge 1020. Because the ledges 1016 are flexible, they are able to accommodate for variations in channel 118 location during installation and assembly.

In an exemplary embodiment, the length of the ledge 1016 along the bottom edge 1020 engages the channels 118. In this embodiment, the top and/or bottom surface of the ledges 1016 can exert pressure on the channels 118 to hold the reflector 100 in place at or proximate the angular or V-shaped bend 1018. In an alternate embodiment, the reflector 100 can be held in place in the reflector attachment 1000 by applying enough force to rotate the alignment features 106 past the angular or V-shaped bend 1018. In this exemplary embodiment, because the alignment features 106 are rotated past the bend 1018, neither the top and/or the bottom surfaces of the ledges 1016 exert any pressure on the channels 118. To remove the reflector 100 from the reflector attachment 1000, the reflector 100 must be rotated with enough force to overcome the force of the angular or V-shaped bend 1018.

An exemplary reflector attachment 1000 includes retaining elements such as stop elements 1022*a* and 1022*b* (collectively referred to herein as stop elements 1022). As illustrated in FIGS. 10A and 10C, stop elements 1022 can extend downward in the direction of the base wall 1002. The stop elements 1022 can extend in a direction orthogonal or substantially orthogonal to the top wall 1004 in the direction of the base wall 1002. In an exemplary embodiment, the stop elements 1022 can be formed from a portion of the top wall 1004 that is bent or otherwise formed to extend in the direction of the base wall 1002. The intersection between the top wall 1004 and the stop elements 1022 can be curved. In an alternate embodiment, the intersection between the top wall 1004 and the stop elements 1022 is chamfered. As the reflector 100 is held in place on the reflector attachment 1000, side walls 112 and/or 114 of the alignment features 106 engage the stop elements 1022 to prevent further rotation of the reflector 100 in the reflector attachment 1000.

In an exemplary embodiment, reflector attachment 1000 includes an tongue 1024 to align the reflector attachment 1000 with the LED module assembly, mounting bar, substrate, or heat sink. The tongue 1024 extends from the top wall 1004 in a direction parallel and/or concurrent with the surface of the top wall 1004. An exemplary tongue 1024 extends beyond the outer surface of the exterior side wall 1006 and engages an interior surface of the LED module assembly, mounting bar, substrate, heat sink, and/or other device to which the reflector attachment 1000 is mating.

In certain exemplary embodiments, the reflector attachments 200, 500, 700, 800, and 1000 are constructed from molded materials, including, but not limited to, plastic, glass-reinforced plastic, aluminum, zinc, magnesium, and the like, and sheet metal or machined (metal and non-metal) materials. In certain embodiments, the reflector attachments 200, 500, 700, 800, and 1000 have an exterior shape other than circular. One having ordinary skill in the art will recognize that the reflectors 100, 400 and reflector attachments 200, 500, 700, 800, and 1000 may have any shape suitable for use with an LED light source.

Figure 11A:
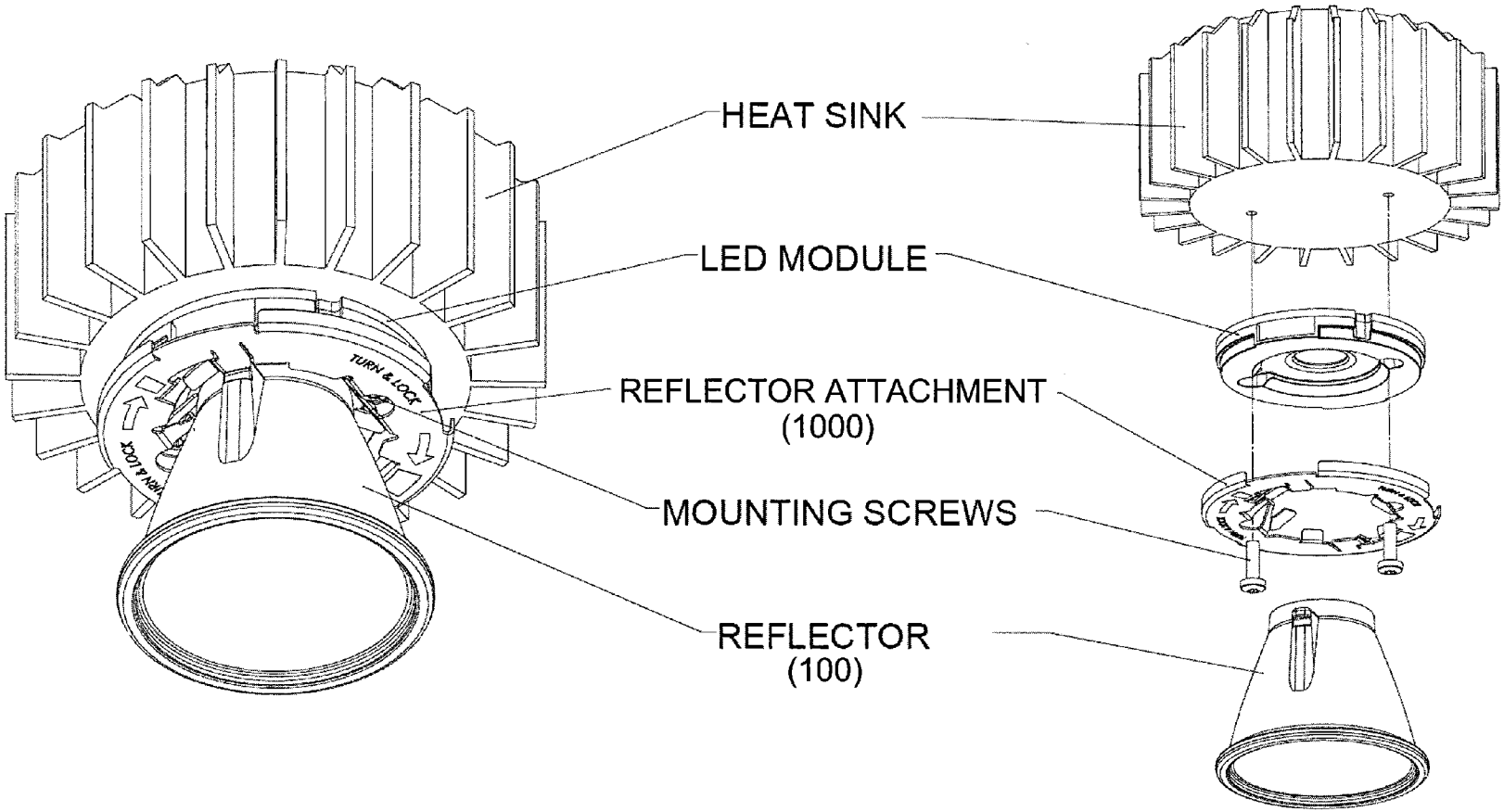
FIG. 11A is an exploded perspective view of a reflector, reflector attachment, LED module, and heat sink according to an exemplary embodiment.

FIG. 11 is a perspective view of the reflector 100 (FIGS. 1A-D) coupled to the reflector attachment 1000 (FIGS. 10A-C) according to one exemplary embodiment. The alignment features 106 are inserted into the corresponding notches 1014 and rotated so that the ledges 1016 engage the channels 118 of the alignment features 106 of the reflector 100. Mounting screws couple the reflector attachment 100 and the LED module to the heat sink. In an exemplary embodiment, the mounting openings on the reflector attachment 100 and/or the LED module can include threaded or non-threaded through holes.

Figure 11B:
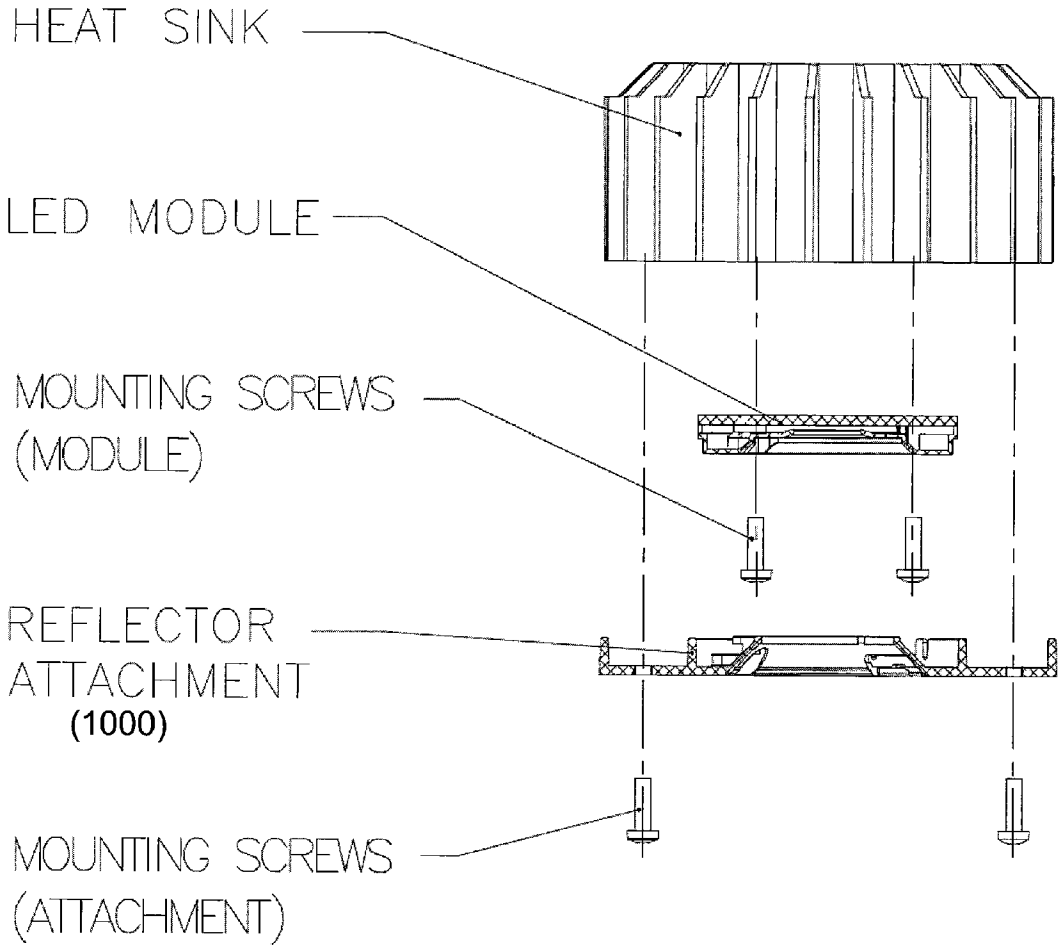
FIG. 11B is an exploded side view of a reflector attachment, LED module, and heat sink according to an exemplary embodiment.

FIG. 11B is an exploded side view of a reflector attachment 1000, LED module, and heat sink according to an exemplary embodiment. FIG. 11B illustrates an alternate exemplary mounting configuration for coupling the reflector attachment 1000 and the LED module to the heat sink. In the exemplary embodiment, the LED module is mounted to the heat sink using a first set of mounting screws. The reflector attachment 1000 is mounted to the heat sink, separate from the LED module, using a second set of mounting screws.

Figure 11C:
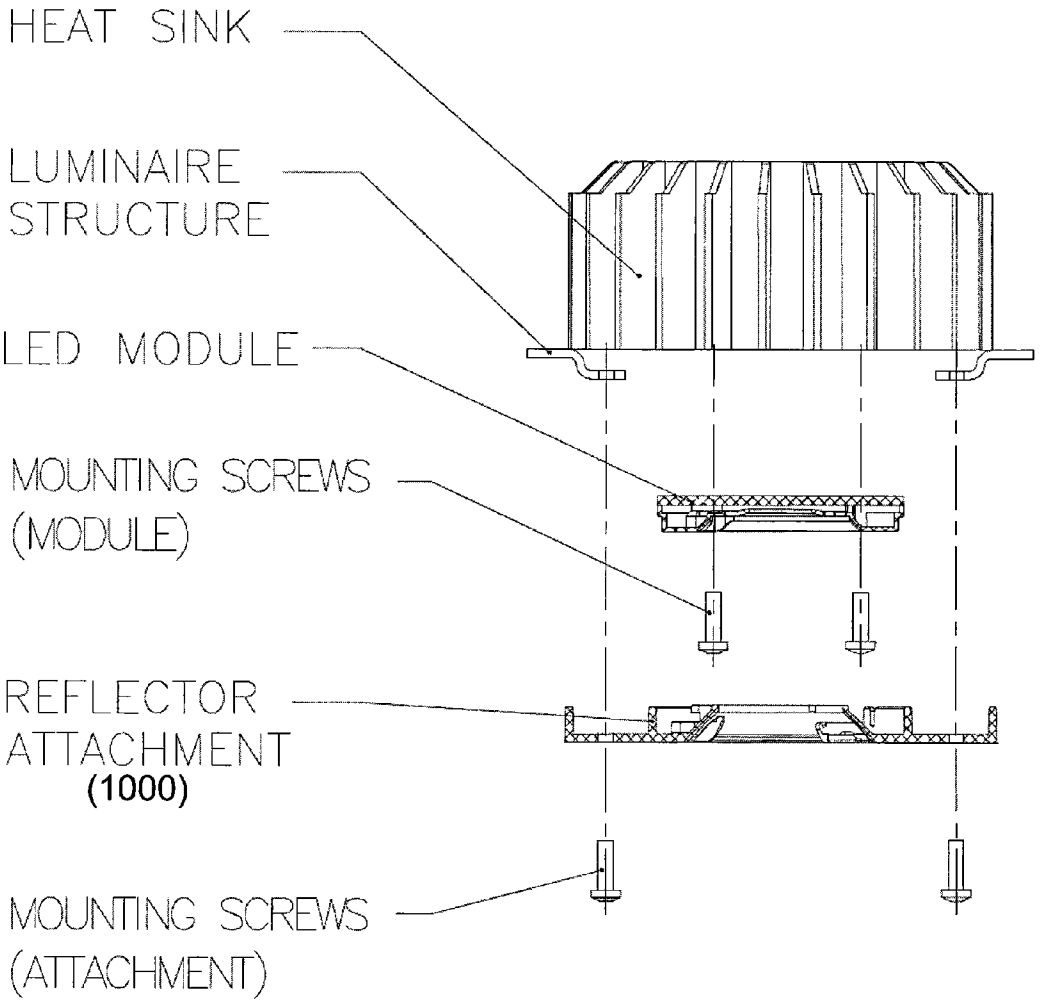
FIG. 11C is an exploded side view of a reflector attachment, LED module, and heat sink according to an exemplary embodiment.

FIG. 11C is an exploded side view of a reflector attachment, LED module, and heat sink according to an exemplary embodiment. FIG. 11 C illustrates an alternate exemplary mounting configuration for coupling the reflector attachment 1000 and the LED module to the heat sink. In the exemplary embodiment, the LED module is mounted to the heat sink using a first set of mounting screws. The reflector attachment 1000 is mounted to the heat sink, separate from the LED module, using a second set of mounting screws. The second set of mounting screw engage or otherwise pass through a portion of the luminaire structure before mounting in the heat sink. In an alternate embodiment, the mounting screws do not engage the heat sink, rather they mount only to the portion of the luminaire structure.

Figure 12A:
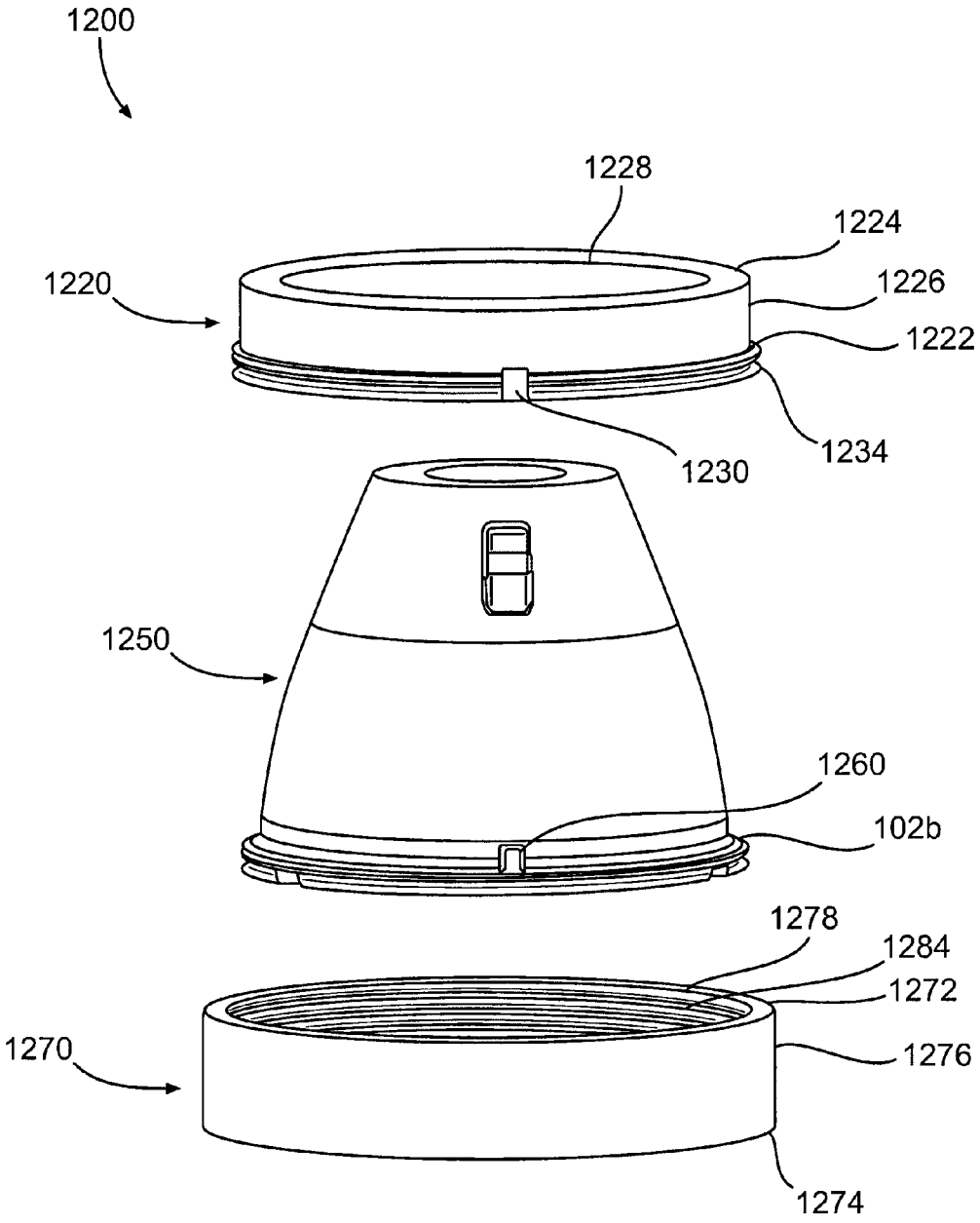
FIG. 12A is an exploded perspective view of a media holder according to an exemplary embodiment.
Figure 12B:
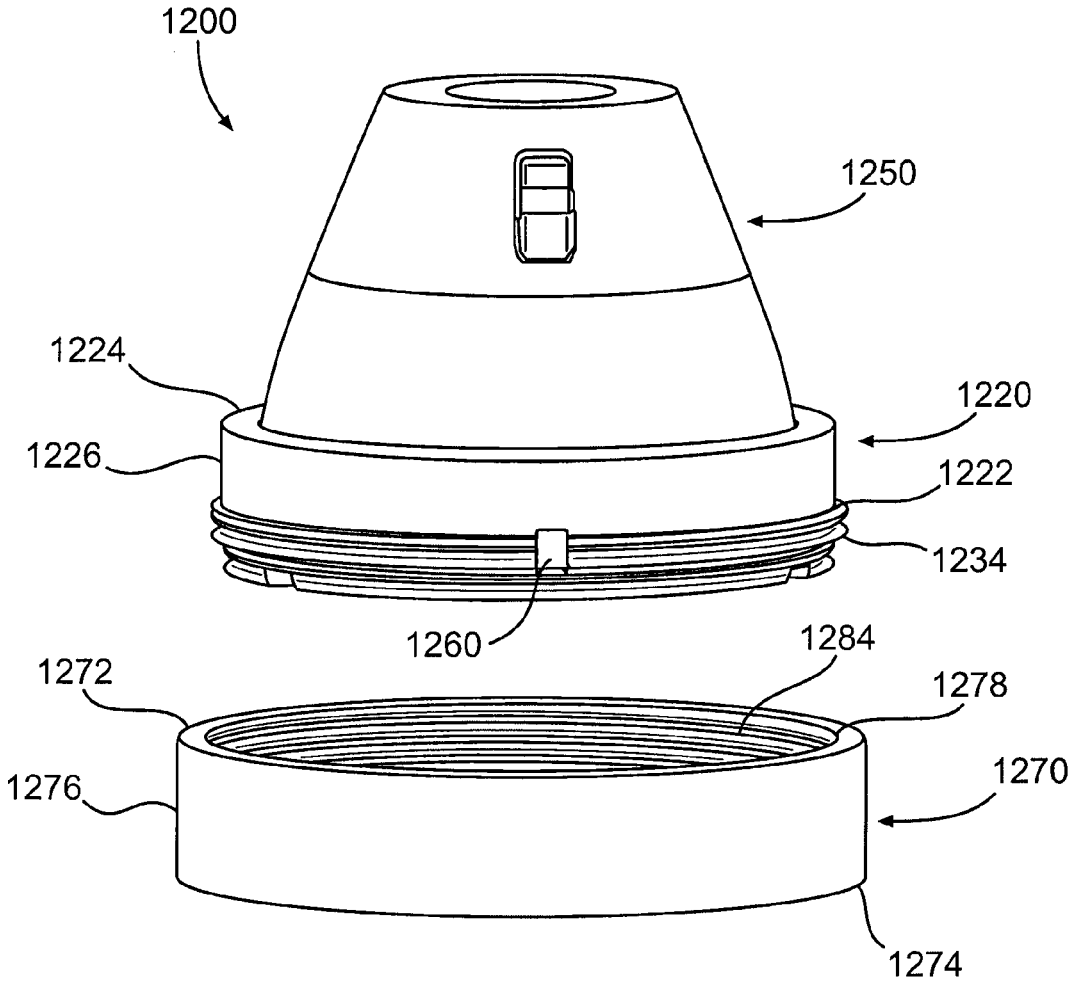
FIG. 12B is a partially exploded perspective view of the media holder of FIG. 12A according to one exemplary embodiment.
Figure 12C:
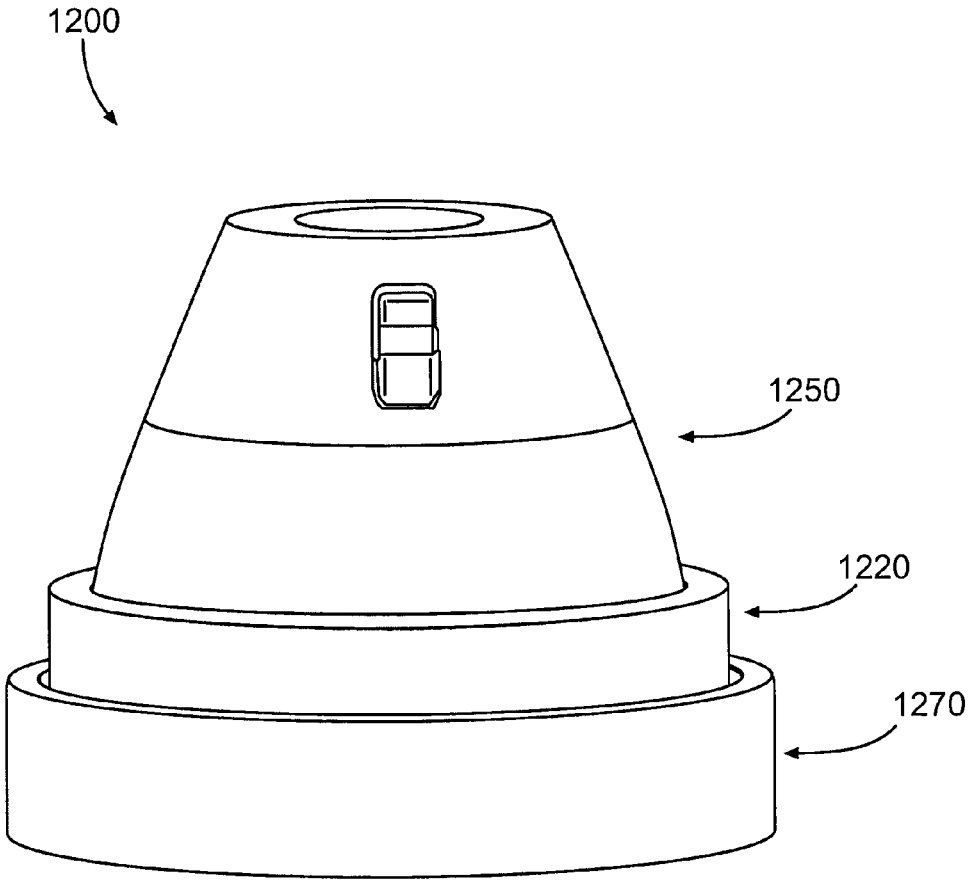
FIG. 12C is a perspective view of the media holder of FIG. 12A according to one exemplary embodiment.

FIG. 12A-C are different views of a media holder 1200 having an upper ring 1220, a reflector 1250, and a front ring 1270 according to one exemplary embodiment. FIG. 12A is an exploded perspective view of the media holder 1200 according to one exemplary embodiment. FIG. 12B is a perspective view of the media holder 1200 showing the upper ring 1220 coupled to the reflector 1250 according to one exemplary embodiment. FIG. 12C is an assembled perspective view of the media holder 1200 according to one exemplary embodiment. The reflector 1250 is the same as that described above with regard to FIGS. 1A-D, except as specifically stated below. For the sake of brevity, the similarities will not be repeated hereinbelow.

The upper ring 1220 generally has an annular shape and includes a first end 1222, an opposing second end 1224, a side wall 1226 extending from the first end 1222 to the second end 1224, and an opening or passageway 1228 defined by the side wall 1226 and extending from the first end 1222 to the second end 1224. In certain exemplary embodiments, the first end 1222 includes a notch 1230 sized and shaped to correspond to a rib 1260 on the reflector 1250; however other shapes that are accommodated by the rib 1260 can also be used. In certain exemplary embodiments, the first end 1222 includes a means for engaging and coupling to the front ring 1270, such as threads 1234. In certain exemplary embodiments, the opening 1228 has a size and shape corresponding to the second end 102*b* of the reflector 1250.

In certain exemplary embodiments, the reflector 1250 includes a rib 1260 positioned on the second end 102*b*. In certain exemplary embodiments, the rib 1260 is a rectangular-shaped protrusion that corresponds to the shape of the notch 1230 in the upper ring 1220. The upper ring 1220 can be coupled to the reflector 1250 by positioning the upper ring 1220 around the second end 102*b* of the reflector 1250 such that the rib 1260 engages the notch 1230 (FIG. 12B).

In certain exemplary embodiments, the front ring 1270 generally has an annular shape and includes a first end 1272, an opposing second end 1274, a side wall 1276 extending from the first end 1272 to the second end 1274, and an opening or passageway 1278 defined by the side wall 1276 and extending form the first end 1272 to the second end 1274. An optical media (not shown) is positioned in the second end 1274 of the front ring 1270. In certain exemplary embodiments, the first end 1272 includes a means for engaging and coupling to the upper ring 1220, such as mating threads 1284. In certain exemplary embodiments, the opening 1278 has an internal size (e.g. diameter) and shape corresponding to the external size (e.g. diameter) and shape of the upper ring 1220. The front ring 1270 can be coupled to the upper ring 1220 by engaging the threads 1234 of the upper ring 1220 with the corresponding mating threads 1284 of the front ring 1270 (FIG. 12C). Once the front ring 1270 is coupled to the upper ring 1220, the media (not shown) is held in place in front of the reflector 1250.

Figure 13A:
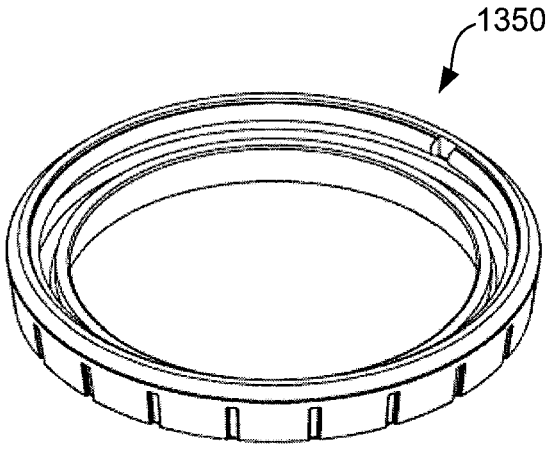
FIG. 13A is a perspective view of a reflector glare shield according to an exemplary embodiment.
Figure 13B:
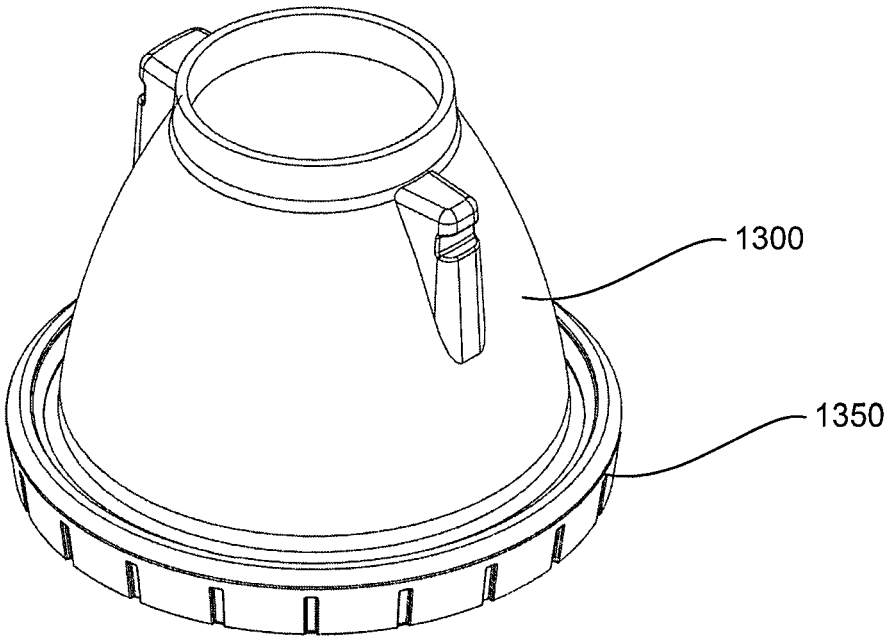
FIG. 13B is a perspective view a reflector attachment and the reflector glare shield of FIG. 13A according to one exemplary embodiment.

In an exemplary embodiment, the reflector includes a reflector glare shield for preventing a halo effect around the second end 102*b* of the reflector when light is being emitted therethrough. A reflector glare shield can also improve the aesthetics of the light fixture as well as protect the reflector from damage. FIG. 13A is a perspective view of an exemplary reflector glare shield 1350. FIG. 13B is a perspective view of a reflector 1300 coupled to an exemplary reflector glare shield 1350.

Figure 13C:
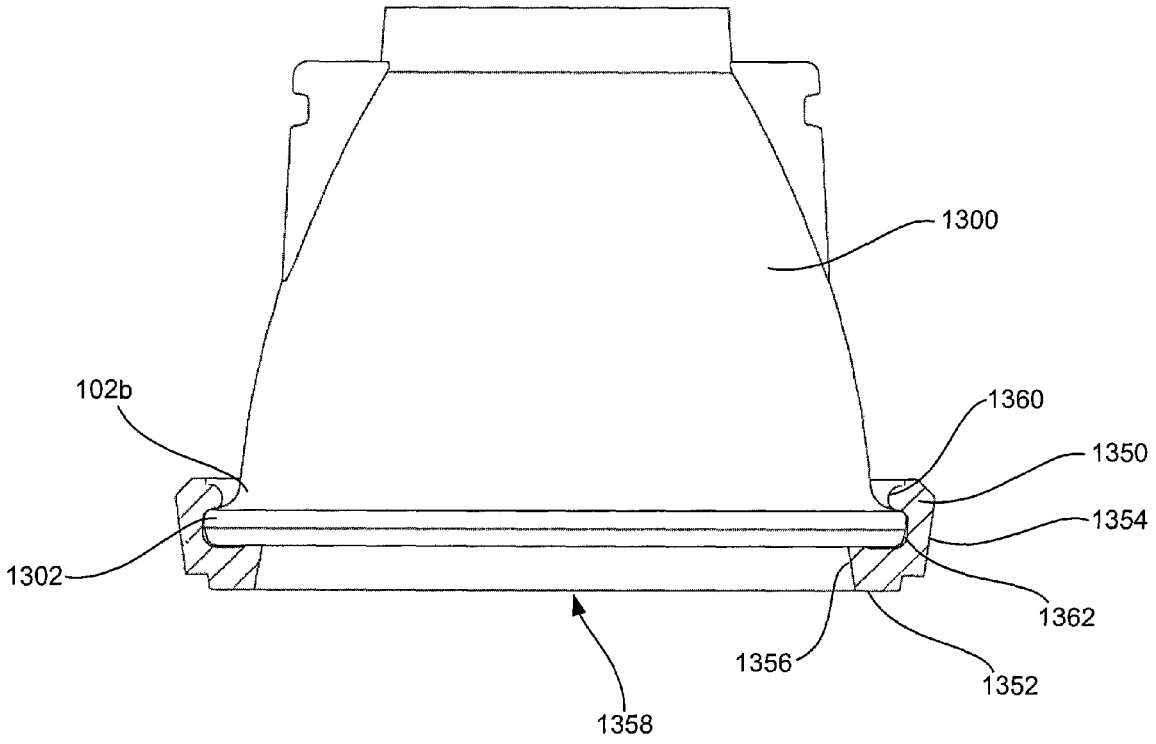
FIG. 13C is a side cross-sectional view of the reflector glare shield of FIG. 13A according to one exemplary embodiment.

FIG. 13C is a side view of a reflector 1300 and a side cross-sectional reflector glare shield 1350. As illustrated in FIG. 13C, the reflector glare shield 1350 is coupled to the reflector 1300 according to one exemplary embodiment. The reflector 1300 is the same as that described above with regard to FIGS. 1A-D, except as specifically stated below. For the sake of brevity, the similarities will not be repeated hereinbelow.

In certain exemplary embodiments, the reflector glare shield 1350 generally has an annular shape and includes a base wall 1352, an exterior side wall 1354 extending orthogonally from the base wall 1352, an interior side wall 1356 opposing the exterior side wall 1354, an opening 1358 defined by the interior side wall 1356, a retaining wall 1360, and a channel 1362 defined by base wall 1352, the exterior side wall 1354, the interior side wall 1356, and the retaining wall 1360. As illustrated in FIGS. 13A and 13B, in certain exemplary embodiment, the exterior side wall 1354 can include vertical grooves and/or channels to aid a user in gripping the reflector glare shield 1350. In an alternate embodiment, the reflector glare shield 1350 can include any other configuration of surface texture, including a smooth surface.

As illustrated in FIG. 13C, in certain exemplary embodiments, the intersection between the base wall 1352 and the exterior side wall 1354 is includes an angled step-shaped portion. In alternate embodiments, the intersection between the base wall 1352 and the exterior side wall 1354 is curved, chamfered, or at an angle greater than or less than 90 degrees. In certain exemplary embodiments, the intersection between the base wall 1352 and the interior side wall 1356 is angled at greater than 90 degrees. In alternate embodiments, the intersection between the base wall 1352 and the interior side wall 1356 is step-shaped, curved, chamfered, or squared, or at an angle less than 90 degrees.

In certain exemplary embodiments, the channel 1362 is sized and shaped to correspond to a flange 1302 at the second end 102*b* of the reflector 1300; however other shapes that are accommodated by the flange 1302 can also be used. The reflector glare shield 1350 can be coupled to the flange 1302 of the reflector 1300 by any means known to one having ordinary skill in the art, including, but not limited to, snap-fit connection, clips, threads, screws, and the like. In certain exemplary embodiments, the retaining wall 1360 engages the upper edge of flange 1302 when the reflector glare shield 1350 is coupled to the reflector 1300 using a snap-fit connection. The reflector glare shield 1350 can be constructed from any material suitable for covering the flange 1302, including, but not limited to plastic, silicon, and rubber.

Figure 14:
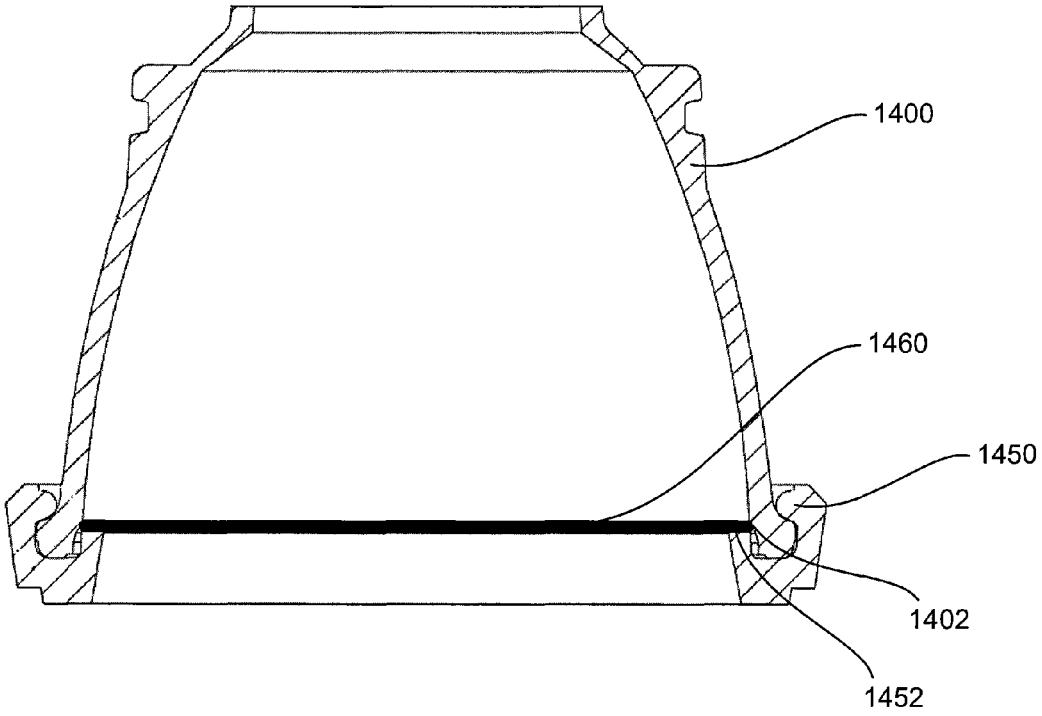
FIG. 14 is a side cross-sectional view of a reflector glare shield and optical media according to one exemplary embodiment.

In an exemplary embodiment, a reflector glare shield can be used to couple an optical filter to the light output from the reflector. FIG. 14 is a side cross-sectional view of a reflector 1400 coupled to an exemplary reflector glare shield 1450. As illustrated in FIG. 14, an optical media 1460 is located proximate the reflector 1400 to impact the light output. The optical media 1460 can include, for example, absorptive and/or interference (dichroic) glass (thin film) filters, hex cell louver, and/or glass lens. In an exemplary embodiment depicted in FIG. 14, the optical media 1460 includes a thin film filter. In an exemplary embodiment, the media 1460 is held between the reflector glare shield 1450 and the reflector 1400. The media 1460 can include a single thin film filter or multiple thin film filters. As illustrated in FIG. 14, media 1406 located between the interior edge 1452 of the reflector glare shield 1450 and the interior edge 1402 of the reflector 1400.

Figure 15A:
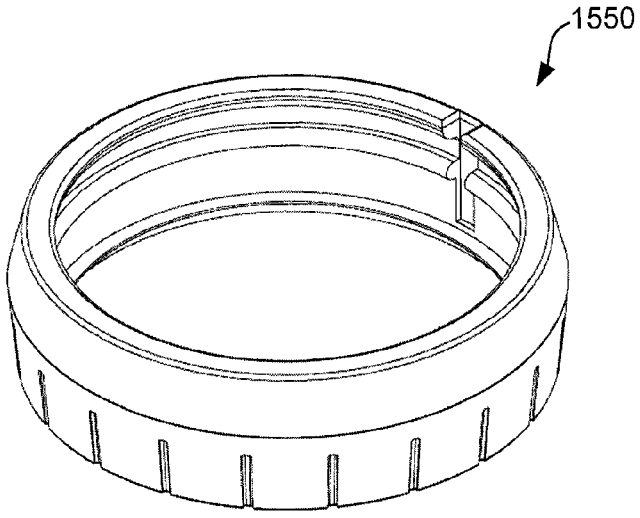
FIG. 15A is a perspective view of a media holder according to one exemplary embodiment.
Figure 15B:
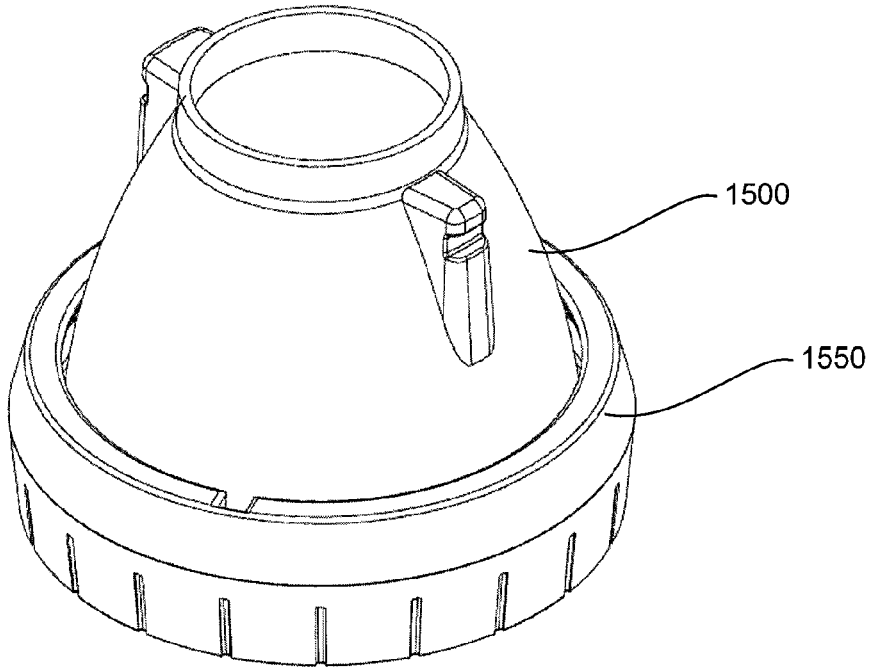
FIG. 15B is a perspective view of a reflector and the media holder of FIG. 15A according to one exemplary embodiment.

In an exemplary embodiment, the reflector includes a media holder for coupling an optical media to the light output from the reflector. FIG. 15A is a perspective view of an exemplary media holder 1550. FIG. 15B is a perspective view of a reflector 1500 coupled to an exemplary media holder 1550. The reflector 1500 is the same as that described above with regard to FIGS. 1A-D, except as specifically stated below. For the sake of brevity, the similarities will not be repeated hereinbelow.

Figure 15C:
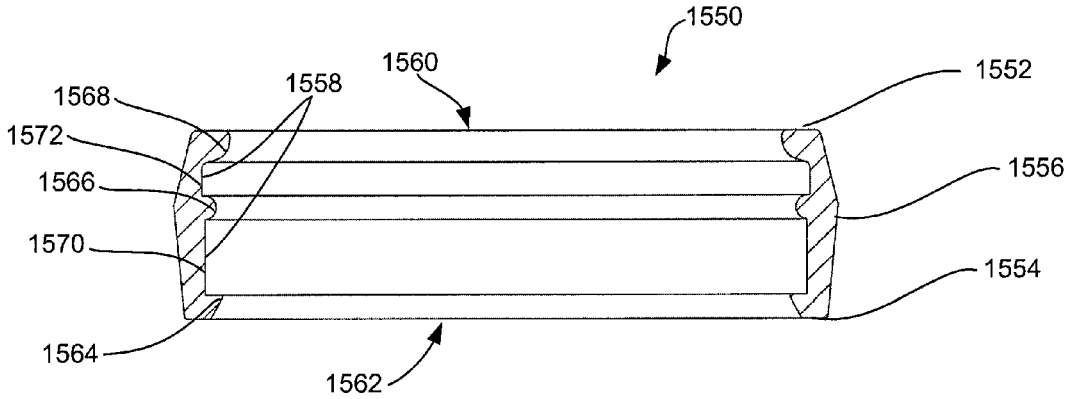
FIG. 15C is a side cross-sectional view of the media holder of FIG. 15A according to one exemplary embodiment.

FIG. 15C is a cross-section view of an exemplary media holder 1550. In certain exemplary embodiments, the media holder 1550 generally has an annular shape and includes a top wall 1552, a base wall 1554, an exterior side wall 1556 extending from the top wall 1552 to the base wall 1554, an interior side wall 1558 opposing the exterior side wall 1556, and top opening 1560 and bottom opening 1562 defined by the interior side wall 1558. In certain exemplary embodiments, the exterior side wall 1556 extends orthogonally or substantially orthogonally from the top wall 1552 to the base wall 1554. The interior side wall 1558 defining a bottom protrusion 1564, a middle protrusion 1566, and a top protrusion 1568. In certain exemplary embodiments, each of the bottom protrusion 1564, middle protrusion 1566, and top protrusion 1568 extends in a direction orthogonal or substantially orthogonal from the surface of the interior side wall 1558. In certain exemplary embodiments, the media holder 1550 includes a bottom channel 1570 and/or a top channel 1572. The bottom channel 1570 can be defined by the bottom protrusion 1564, the interior side wall 1558, and the middle protrusion 1566. The top channel 1572 can be defined by the middle protrusion 1556, the interior side wall 1558, and the top protrusion 1568.

In certain exemplary embodiment, the exterior side wall 1554 can include vertical grooves, channels, and/or protuberance to aid a user in gripping the media holder 1550. In an alternate embodiment, the media holder 1550 can include any other configuration of surface texture, including a smooth surface.

In certain exemplary embodiments, the intersection between the base wall 1554 and the bottom protrusion 1564 is angled at greater than 90 degrees. It is also contemplated that the intersection between the base wall 1554 and the bottom protrusion 1564 can be curved, chamfered, square, or at an angle less than 90 degrees. In certain exemplary embodiments, the intersection between the top wall 1552 and the top protrusion 1568 is curved. In certain exemplary embodiments, the profile of the bottom protrusion 1564, middle protrusion 1566, and the top protrusion 1568 is curved, geometric, and/or any other shape necessary for retaining the reflector 1500 and media 1574 to/within the media holder 1550.

Figure 15D:
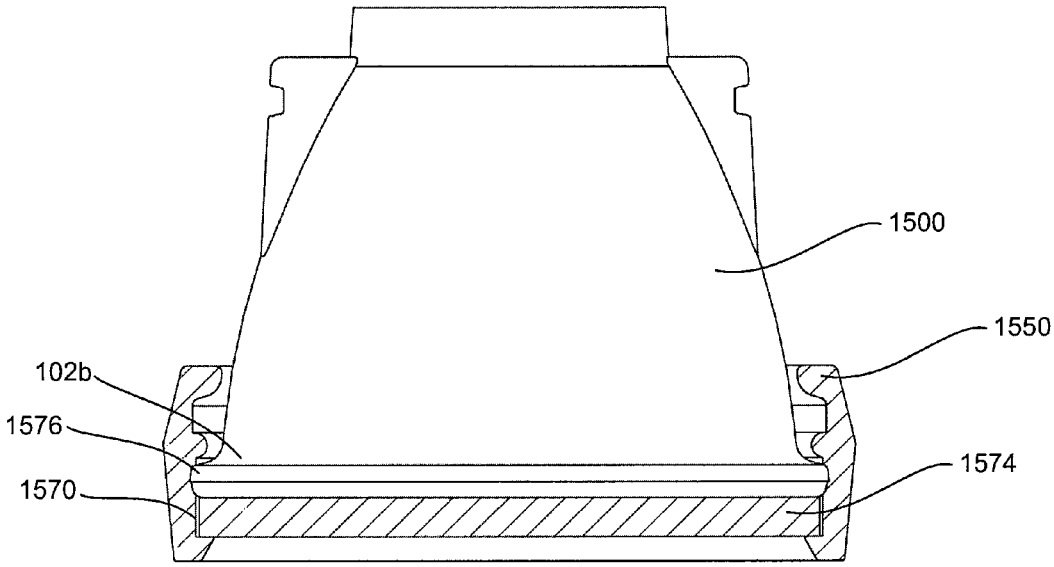
FIG. 15D is a side cross-sectional view of the reflector and media holder of FIG. 15B according to one exemplary embodiment.

FIG. 15D is a side view of a reflector 1500 and a side cross-sectional view of a media holder 1550 attached to the reflector 1500, the medial holder including an media 1574. In certain exemplary embodiments, the media 1574 includes a lens that is transparent, translucent, and/or may be shaded a particular color. In an exemplary embodiment, the media 1574 is held in the bottom channel 1570 when the media holder 1550 is coupled to the reflector 1500. In certain exemplary embodiments, the bottom channel 1570 is sized and shaped to correspond to a flange 1576 at the second end 102*b* of the reflector 1500; however other shapes that are accommodated by the flange 1576 can also be used. In an alternate embodiment (not shown), the media 1574 is held in the bottom channel 1570 and the reflector 1500 is coupled to the media holder at the upper channel 1572. In the alternate embodiment, the upper channel 1572 is sized and shaped to correspond to the flange 1576 of the reflector and the bottom channel 1572 is sized and shaped to correspond to the media 1574.

The media holder 1550 can be removably coupled to the flange 1576 of the reflector 1500 by any means known to one having ordinary skill in the art, including, but not limited to, elasticity of the material making up the medial holder 1550, snap-fit connection, clips, threads and the like. In an exemplary embodiment, the media 1574 is press-fit into bottom channel 1570 of the media holder 1500. The media holder 1550 is then pressed onto the reflector 1500. Flange 1576 is pressed past top protrusion 1568, top channel 1572, and middle protrusion 1566 to the bottom channel 1570. When assembled, the bottom edge of the reflector 1500/flange 1576 can contact the top surface of the media 1574. In an alternate embodiment, the bottom edge of the reflector 1500/flange 1576 is proximate, but not touching, the top surface of the media 1574. A gap between the media 1574 and the reflector 1500 can exist without compromising the function of the media 1574 with respect to the light emitted from the LED module.

Figure 15E:
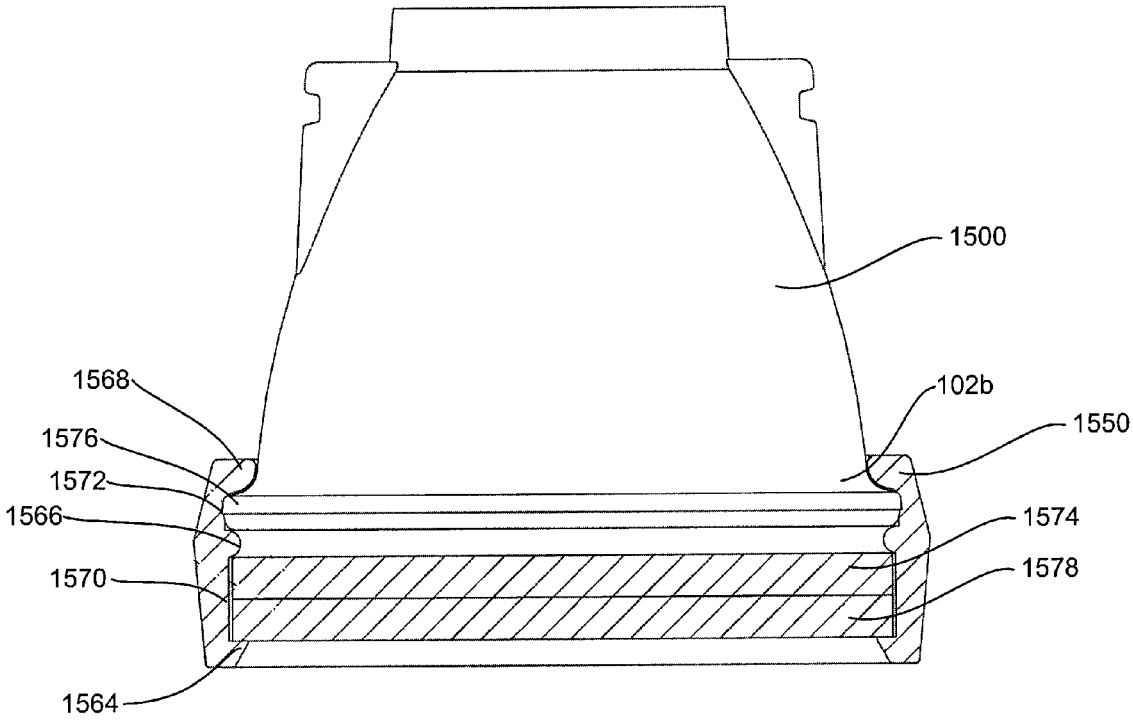
FIG. 15E is a side cross-sectional view of the reflector and media holder of FIG. 15B according to one exemplary embodiment.

FIG. 15E is a side view of the reflector 1500 and a side cross-sectional view of the media holder 1550 including multiple optical media (media 1574 and 1578). In an exemplary embodiment, the media 1574 and media 1578 can include glass lens. Media 1574 and media 1578 can be the same or complementing type/style of optical media.

In an exemplary embodiment, media 1574 and media 1578 are held in the bottom channel 1570 when the flange 1576 is coupled to the media holder 1550 at top channel 1572. In certain exemplary embodiments the bottom channel 1570 is sized and shaped to correspond to media 1574 and 1578. In a further exemplary embodiment, channel 1570 is sized and shaped to correspond to lenses media 1574, 1578, and additional optical lenses (not shown). In certain exemplary embodiments, flange 1576 is held in the top channel 1572 of the media holder 1550. The top channel 1572 is sized and shaped to correspond to the flange 1576 at the second end 102*b* of the reflector 1500. In an alternate embodiment (not shown), the bottom channel 1570 can hold one optical media element (media 1574 or media 1578) and top channel 1572 can engage the flange 1576. Additional or fewer media held in bottom channel 1576 and/or top channel 1572 are contemplated.

The media holder 1550 can be coupled to the flange 1576 of the reflector 1500 using the elasticity of all or a portion of the material making up the medial holder 1550, a snap-fit connection, clips, threads, and the like. In an exemplary embodiment, media 1574 and 1578 are press fit into bottom channel 1570 of the media holder 1500. Flange 1576 is pressed past the top protrusion 1568 to engage top channel 1572. The top protrusion 1568 can exert a compressive force on the flange 1576 and/or second end 102*b* of the media holder 1550. To remove the media holder 1550 from the reflector 1500, a force must be applied to overcome that which is applied by the top protrusion 1568 on the flange 1576 and/or second end section 102*b*. The media holder 1550 can be attached to the reflector 1500 before or after the reflector 1550 is attached to the LED module thereby permitting quick attachment and removal of media 1574 and 1578 from the light output from the reflector 1500.

As illustrated in FIG. 15E, the exemplary media holder 1550 includes a middle protrusion 1566. The middle protrusion provides a gap between the top surface of media 1574 and the bottom surface of the reflector 1500. In an alternate embodiment, middle protrusion 1566 can be configured such that the gap between the top surface of media 1574 and the bottom surface of the reflector 1500 is reduced or made greater depending on the optical properties required of the light output the LED module. In an alternate embodiment, media holder 1550 can exclude the middle protrusion 1566. The depth of the bottom channel 1570 in the horizontal direction can be less than the depth of the top channel 1572 such that flange 1576 cannot engage the bottom channel 1570 and only fits the top channel 1572. As a result, when assembled, media 1574 and 1578 are held in bottom channel 1570 and flange 1576 is in top channel 1572, without a protrusion between.

The exemplary embodiments disclosed herein are illustrative only, as the invention may be modified and practiced in different but equivalent manners apparent to those having ordinary skill in the art and having the benefit of the teachings herein. While numerous changes may be made by those having ordinary skill in the art, such changes are encompassed within the spirit and scope of this invention. Furthermore, no limitations are intended to the details of construction or design herein shown. It is therefore evident that the particular illustrative embodiments disclosed above may be altered or modified and all such variations are considered within the scope and spirit of the present invention.

We claim:

1. A luminaire comprising:

a light emitting diode (LED) module assembly comprising:

a LED light source; and a reflector attachment disposed about the LED light source; and a reflector rotatably coupled to the reflector attachment, the reflector comprising:

a non-conductive substrate having an interior surface and an exterior surface.

2. The luminaire of claim 1, wherein the substrate is constructed from a material selected from the group consisting of glass and plastic.

3. The luminaire of claim 1, further including:

a non-conductive reflective coating disposed on the interior surface for reflecting light emitted from said LED light source, wherein the non-conductive reflective coating is selected from the group consisting of titanium dioxide and silicon dioxide.

4. The luminaire of claim 1, wherein the reflector comprises a plurality of alignment features disposed on the exterior surface;

wherein the reflector attachment comprises a plurality of notches disposed within an interior wall of the reflector attachment; and wherein the each one of the plurality of alignment features engages one of the plurality of notches to rotatably couple the reflector to the reflector attachment.

5. The luminaire of claim 4, wherein the each of the plurality of alignment features have different dimensions and each of the plurality of notches have different dimensions, wherein the alignment features engage the notches in only one orientation to rotatably couple the reflector to the reflector attachment.

6. A reflector system comprising:

a reflector comprising:

an exterior surface, and an alignment feature protruding from the exterior surface, wherein the alignment feature includes a channel.

7. The reflector system of claim 6, further including:

a reflector attachment having an opening for receiving a first end of the reflector, the reflector attachment further comprising:

a groove corresponding to the size and shape of the alignment feature, and a ledge adjacent to the grooves, the ledge being sized to engage the channel of the alignment feature when the reflector is coupled to the reflector attachment and an underside of the ledge including a retaining element.

8. The reflector system of claim 6, wherein the ledge is flexible in a direction parallel to a light pathway through the reflector.

9. The reflector system of claim 6, further comprising:

a media holder having a first channel sized to engage a flange of the reflector when the reflector is coupled to the media holder, wherein the reflector further comprises the flange extending from a second end of the reflector opposite the first end.

10. The reflector system of claim 6, wherein the ledge further includes a spring element.

11. The reflector system of claim 6, wherein the ledge is anchored to the reflector attachment at only one edge of the ledge.

12. The reflector system of claim 6, wherein the reflector attachment further comprises:

a mounting opening for receiving a fastener for coupling the reflector attachment to a heat sink; and an alignment tab adjacent to the mounting opening extending in a direction away from a top surface of the reflector attachment for aligning the opening with the light-emitting module.

13. A reflector for a light emitting-diode (LED) light source, the reflector comprising:

a first light receiving aperture disposed on a first end of the reflector;

a distal light emitting aperture disposed on a second end of the reflector;

an interior surface disposed between the first and second ends and defining a light pathway through the reflector;

a flange member extending out from an exterior surface of the reflector adjacent to the second end; and a media holder removably coupled to the second end of the reflector and having at least a portion disposed over the flange member, the media holder comprising:

an annular-shaped body portion comprising:

a first protrusion located adjacent to a top surface of the annular-shaped body portion, the first protrusion extending from an inner surface of the annular-shaped body portion;

a second protrusion located adjacent to a bottom surface of the annular-shaped body portion, the second protrusion extending from the inner surface of the annular-shaped body portion; and a first channel on an inner surface of the annular-shaped body portion located between the top protrusion and the bottom protrusion;

a media removably coupled to the media holder and having an outer perimeter surface disposed within the first channel.

14. The reflector of claim 13, wherein the first channel of the annular-shaped body portion is sized to engage the media and the second end of the reflector.

15. The reflector of claim 13, wherein the annular-shaped body portion further comprises:

a third protrusion located between the first channel and the second protrusion;

a second channel on an inner surface of the annular-shaped body portion located between the third protrusion and the second protrusion.

16. The reflector of claim 15, wherein the second channel is sized to engage a bottom edge of the reflector.

17. The reflector of claim 16, further comprising a second media removably coupled to the media holder and having an outer perimeter surface disposed within the first channel, wherein the media abuts the second media within the first channel.

18. The reflector of claim 13, wherein the media holder is configured to snap-fit couple to the reflector.

19. The reflector of claim 13, wherein the media holder is constructed from an elastic material.

20. The reflector of claim 18, wherein the media holder is constructed from silicon.

* * * * *